US012584483B2

(12) United States Patent
Dearden

(10) Patent No.: US 12,584,483 B2
(45) Date of Patent: Mar. 24, 2026

(54) PUMP AND METHOD TO ATTENUATE PULSES AT THE DISCHARGE

(71) Applicant: Magpumps Limited, Lyndhurst (GB)

(72) Inventor: Leo Dearden, Lyndhurst (GB)

(73) Assignee: Magpumps Limited, Lyndhurst (GB)

( * ) Notice: Subject to any disclaimer, the term of this patent is extended or adjusted under 35 U.S.C. 154(b) by 37 days.

(21) Appl. No.: 18/434,078

(22) Filed: Feb. 6, 2024

(65) Prior Publication Data

US 2024/0240635 A1 Jul. 18, 2024

Related U.S. Application Data

(63) Continuation-in-part of application No. 16/486,229, filed as application No. PCT/EP2018/025040 on Feb. 15, 2018, now abandoned.

(30) Foreign Application Priority Data

Feb. 15, 2017 (GB) ..... 1702488

(51) Int. Cl.
*F04C 2/10* (2006.01)
*F04C 5/00* (2006.01)
(Continued)

(52) U.S. Cl.
CPC ..... *F04C 2/102* (2013.01); *F04C 11/001* (2013.01); *F04C 14/08* (2013.01);
(Continued)

(58) Field of Classification Search
CPC ..... F04C 2/102; F04C 11/001; F04C 14/08; F04C 15/0049; F04C 15/0096; F04C 5/00;
(Continued)

(56) References Cited

U.S. PATENT DOCUMENTS 4,940,394 A * 7/1990 Gibbons ..... F04C 2/123 417/283
5,145,329 A 9/1992 Zumbusch et al.
(Continued)

FOREIGN PATENT DOCUMENTS

CN 1453476 A 11/2003
DE 1096755 B 1/1961
(Continued)

OTHER PUBLICATIONS

Google search for Young's Modulus for stainless steel and rubber, Jul. 26, 2025, 2 pages. (Year: 2025).*
(Continued)

*Primary Examiner* — Mary A Davis
(74) *Attorney, Agent, or Firm* — Ziegler IP Law Group, LLC.

(57) ABSTRACT

A gerotor pump includes a pump head including a configuration of gerotors for pumping in operation a fluid medium from an input port arrangement to an output port arrangement, and a motor arrangement for providing mechanical power in operation for actuating the configuration of gerotors. The configuration of gerotors includes an outer gerotor and an inner gerotor that are operable to cooperate to entrap and propel the fluid medium from the input port arrangement to the output port arrangement. At least one of the outer gerotor and the inner gerotor are fabricated from a flexible material and/or are internally structured so as to exhibit a flexible peripheral exterior surface in operation. Moreover, the outer gerotor and the inner gerotor are loaded and/or are assembled together in a preloaded state, within the pump head, so that a gap formed between the gerotors whereat they mutually cooperate for entrapping and propelling the fluid medium is maintained in a flexibly compressed state when the pump is in operation. Optionally, at least one of the outer and inner gerotors is fabricated as a hybrid component
(Continued)

including regions of a flexible material therein, and regions of an inflexible material therein. More optionally, the flexible material has a Young's modulus in a range of 1 MegaPascal (MPa) to 5 GigaPascals (GPa), and the inflexible material has a Young's modulus in a range of 2 GPa to 420 GPa. Optionally, at least one gerotor gerotor pump is includes in a gerotor pump apparatus that includes a pulse attenuating arrangement at an output port of the gerotor pump apparatus for attenuating periodic pulses and fluctuations in a fluid flow provided in use at the output port.

29 Claims, 9 Drawing Sheets

(51) Int. Cl.
*F04C 11/00* (2006.01)
*F04C 14/08* (2006.01)
*F04C 15/00* (2006.01)

(52) U.S. Cl.
CPC ..... *F04C 15/0049* (2013.01); *F04C 15/0096* (2013.01); *F04C 5/00* (2013.01); *F04C 2240/20* (2013.01); *F04C 2270/03* (2013.01); *F04C 2270/145* (2013.01); *F04C 2270/18* (2013.01); *F04C 2270/20* (2013.01)

(58) Field of Classification Search
CPC ..... F04C 2240/20; F04C 2270/03; F04C 2270/145; F04C 2270/18; F04C 2270/20
See application file for complete search history.

(56) References Cited

U.S. PATENT DOCUMENTS

| | | | | |
|---|---|---|---|---|
| 2003/0202891 | A1 | 10/2003 | Nakano et al. | |
| 2004/0101427 | A1 | 5/2004 | Yu et al. | |
| 2005/0106044 | A1* | 5/2005 | Ohnishi | F04C 2/102 417/440 |
| 2006/0120908 | A1* | 6/2006 | Ohnishi | F04C 2/102 418/61.3 |
| 2012/0020820 | A1* | 1/2012 | Francini | F04C 2/102 137/565.17 |
| 2012/0288390 | A1 | 11/2012 | Yang | |
| 2022/0349402 | A1* | 11/2022 | Dearden | F04C 14/08 |

FOREIGN PATENT DOCUMENTS

| | | | |
|---|---|---|---|
| DE | 102011082578 | A1 | 3/2013 |
| GB | 1567422 | A | 5/1980 |
| JP | H03179187 | A | 8/1991 |
| WO | 01/48354 | A1 | 7/2001 |
| WO | 2015/083458 | A1 | 6/2015 |

OTHER PUBLICATIONS

Machine translation with foreign for WIPO Publication WO 2015/083458 A1, 1st Inventor: Inazaki; Title: Coolant Pump and Binary Power Generation System Such Coolant Pump; Published: Nov. 6, 2015. (Year: 2015).*

Machine translation for German Patent Publication DE 10 2011 082 578 A1; 1st Inventor: Fuchs; Title: Gear Pump for Conveying Fluid, Particularly for Delivering Fuel in High-pressure Fuel Injection System . . . ; Published: Mar. 14, 2013. (Year: 2013).*

Japanese Patent Publication and Machine Translation for JP 2001-90669; 1st Inventor: Yamai; Title: Hydraulic Device; Published: Apr. 3, 2001. (Year: 2001).*

International Bureau of WIPO, International Preliminary report on Patentability issued for International Patent Application PCT/EP2018/025040 on Aug. 29, 2019, 7 Pages.

China Patent Office, First Office Action issued for Chinese Patent Application CN201880012072.4 on Feb. 26, 2021, 12 Pages. English Comments Attached.

European Patent Office, Communication pursuant to Article 94(3) EPC issued for European Patent Application EP18709260.6 on Jul. 15, 2021, 5 Pages.

UK Intellectual Property Office, Combined Search and Examination Report under Sections 17 and 18(3), GB Application No. GB1702488.6, dated Jul. 19, 2017, 5 pages.

European Patent Office, International Search Report and Written Opinion received for International Patent Application No. PCT/EP2018/025040, dated May 16, 2018, 9 pages.

* cited by examiner

PUMP AND METHOD TO ATTENUATE PULSES AT THE DISCHARGE

CROSS-REFERENCE TO RELATED APPLICATIONS

This application is a continuation-in-part of U.S. patent application Ser. No. 16/486,229, titled "PUMP AND METHOD" and filed on Aug. 15, 2019, which is incorporated herein by reference.

TECHNICAL FIELD

The present disclosure relates generally to pumps, for example to gerotor pumps. Moreover, the present disclosure relates to methods for (namely, method of) manufacturing aforementioned pumps, and also methods for (namely, methods of) operating aforementioned pumps.

BACKGROUND

There often arises a requirement to transport fluid media (such as water, oil, fuel, liquid waste and so forth) from one location to another. Generally, such transportation can be accomplished using devices such as pumps. Conventionally, the pumps include rotary pumps and reciprocating pumps that employ (namely, use) one or more movable components for pumping the fluid media. Furthermore, such pumps may include a motor arrangement comprising a motor for providing mechanical power (for example, rotation) for moving the one or more movable components of the pump. However, due to a presence of electrical components (such as windings) carrying electric power in a motor of a given pump, the motor is mechanically isolated from the given pump and from a fluid medium flowing therethrough to prevent damage to the motor.

In conventional pumps, such as rotary positive displacement pumps, such mechanical isolation of a given motor from a given pump (and the fluid medium) is achieved by use of mechanical seals. For example, the mechanical seals may include bellow type mechanical seals, cartridge seals, unbalanced mechanical seals and so forth. However, conventional mechanical seals generally suffer from multiple disadvantages, such as an inability to prevent completely leakage of the fluid medium to the given motor. Moreover, the mechanical seals may experience wear with prolonged usage of the given pump, thereby causing more leakage of the fluid medium to the given motor. Furthermore, such a seal failure may cause damage to the given motor and the given pump.

A further contemporary issue concerns conventional pumps utilizing mechanical seals for preventing leakage usually requiring manufacturing with increased tolerance that may be costly to achieve. Moreover, such conventional pumps may be susceptible to jamming due to thermal expansion of movable components of the conventional pumps and/or a presence of particulates in the fluid medium. Additionally, such conventional pumps may be unable to pump all fluid medium that is suctioned from corresponding inlets thereof, due to a presence of gaps (such as clearance) between their one or more movable components. Such fluid medium entrapped between the one or more movable components may be difficult to clean and may further lead to staleness (due to sedimenting and/or coagulating thereof) and/or damage to the pumps.

Therefore, in light of the foregoing discussion, there exist problems associated with stagnancy of fluid media between one or more movable components of a conventional known type of pump. Moreover, there exist problems with tolerances of one or more moveable pump component parts for achieving a high degree of sealing performance that is required when pumping fluids during extensive periods of time.

Another problem encountered when using conventional pumps is temporal pulsation in fluidic pressure of fluid, and corresponding pulsation in flow rate, pumped out at respective output ports of the pumps, wherein the temporal pulsation may be due to at least one of: fluid flow turbulence (oscillations), movement of individual teeth of rotor wheels as they mutually engage and disengage when in use, reciprocating movement of pump components. Such temporal pulsation is, for example, encountered in piston pumps, centrifugal pumps, turbo-pumps, and also in gerotor pumps. Such pulsation provides, for example, inaccurate dispensing when the conventional pumps are used to dispense minute and highly quantitatively accurate amounts of fluid material in microelectronic production facilities, in pharmaceutical medicine manufacturing facilities, in nuclear reprocessing industries, in precision 3-D printing facilities and such like. A conventional approach is to smooth such pulsations by including a smoothing reservoir at the output port of a given pump, wherein such a smoothing reservoir reduces dynamic fluid dispensing accuracy and results in increased fluid transport delay through the given pump due to inclusion of the smoothing reservoir, when in operation.

In a published United States patent application US2003/202891A1 (Matsushita; "Refrigerant Pump") (also published as U.S. Pat. No. 7,040,875B2), there is described a refrigerant pump that includes a thin-walled hermetic vessel and a thick-walled hermetic vessel having an end inserted into and secured to an end of the thin-walled hermetic vessel. A stator of an electric motor unit is fitted outside the thin-walled hermetic vessel, while a rotor of the electric motor unit is accommodated inside the thin-walled hermetic vessel. A pump mechanism is fitted inside the thick-walled hermetic vessel, and a rotational force of the rotor is transmitted to the pump mechanism by a drive shaft.

In a published PCT patent application WO2016/083458A1 (Kobe Steel Ltd.; "Coolant Pump and Binary Power Generation System using such Coolant Pump"), there is described a compact coolant pump that is alleged to improve motor efficiency and that can stably feed a liquefied coolant. Moreover, there is also described a binary power generation system using such a coolant pump. A coolant pump comprises: a pump unit for feeding a liquefied coolant by elevation of pressure; a motor unit for driving the pump unit; a drive shaft for transmitting rotational drive force produced by the motor unit to the pump unit; and a casing that comprises a pump chamber and a motor chamber that house the pump unit and the motor unit, respectively, in sealed states. The pump unit is an internal gear pump disposed on an end of the drive shaft. The drive shaft comprises through-holes that enable communication between the pump chamber and the motor chamber. The casing comprises an exhaust flow path that connects the motor chamber to a low-pressure line of a binary power generation.

In a published United Kingdom patent application GB1567422A (Bosch; "Fuel Feed Unit for an Internal-Combustion Engine"), there is described a fuel feed unit for an internal combustion engine, wherein the fuel feed unit comprises a rotary pump part and an electrical motor, wherein the electrical motor is drivingly connected to a pump rotor of the rotary pump part, and the pump rotor is in a form of a disc which is received in a working chamber. At least one side surface of the disc is in frictional engagement with an adjacent end wall of the working chamber. Moreover, a recess is provided in the or each side surface of the disc and/or in the adjacent end wall of the working chamber, whereby the area of contact between the surface and the wall is reduced while leaving a continuous contact strip in the peripheral region of the disc or the wall serving as a seal for the working chamber.

SUMMARY

The present disclosure seeks to provide a pump including a pump head utilizing in operation one or more moveable components for pumping a fluid medium from an input port arrangement to an output port arrangement, and a motor arrangement coupled to the pump head for providing mechanical power for moving the one or more moveable components for pumping the fluid medium.

The present disclosure also seeks to provide a method of producing a pump including a pump head utilizing in operation one or more moveable components for pumping a fluid medium from an input port arrangement to an output port arrangement, and a motor arrangement coupled to the pump head for providing mechanical power for moving the one or more moveable components for pumping the fluid medium.

The present disclosure further seeks to provide a method for (namely, a method of) operating a pump including a pump head utilizing in operation one or more moveable components for pumping a fluid medium from an input port arrangement to an output port arrangement, and a motor arrangement coupled to the pump head for providing mechanical power for moving the one or more moveable components for pumping the fluid medium.

Additionally, the present disclosure seeks to provide a gerotor pump including a pump head including a configuration of gerotors for pumping in operation a fluid medium from an input port arrangement to an output port arrangement, and a motor arrangement for providing mechanical power in operation for actuating the configuration of gerotors.

Furthermore, the present disclosure seeks to provide a method for (namely, a method of) producing a gerotor pump including a pump head including a configuration of gerotors for pumping in operation a fluid medium from an input port arrangement to an output port arrangement, and a motor arrangement for providing mechanical power in operation for actuating the configuration of gerotors.

The present disclosure also seeks to provide a pump including a pump head utilizing in operation one or more moveable components for pumping a fluid medium from an input port arrangement to an output port arrangement, and a motor arrangement coupled to the pump head for providing mechanical power for moving the one or more moveable components for pumping the fluid medium.

The present disclosure also seeks to provide a pump apparatus including a pump including a pump head utilizing in operation one or more moveable components for pumping a fluid medium from an input port arrangement to an output port arrangement, and a motor arrangement coupled to the pump head for providing mechanical power for moving the one or more moveable components for pumping the fluid medium, wherein the pump apparatus is further configured to actively reduce pulse variations at the output port arrangement in response to rotation in use of the one or more moveable components.

According to a first aspect, there is provided a gerotor pump apparatus including at least one gerotor pump including a pump head including a configuration of gerotors for pumping in operation a fluid medium from an input port arrangement to an output port arrangement, and a motor arrangement for providing mechanical power in operation for actuating the configuration of gerotors, wherein the configuration of gerotors includes an inner gerotor and an outer gerotor that are operable to cooperate to entrap and propel the fluid medium from the input port arrangement to the output port arrangement, at least one of the outer gerotor and the inner gerotor are fabricated from a flexible material and/or are internally structured so as to exhibit a flexible peripheral exterior surface in operation, the outer gerotor and the inner gerotor are loaded and/or are assembled together in a preloaded state, within the pump head, so that a gap formed between the gerotors whereat they mutually cooperate for entrapping and propelling the fluid medium is maintained in a flexibly compressed state when the gerotor pump is in operation, and the gerotor pump apparatus further includes a pulse attenuating arrangement for reducing an amplitude of periodic pulses present at the output port arrangement generated in response to rotation of the outer gerotor and inner gerotor when in use, wherein the pulse attenuation arrangement is configured to apply an at least partially antiphase correction to attenuate the amplitude of the periodic pulses at the output port arrangement.

Optionally, for the gerotor pump apparatus, the pulse attenuating arrangement is implemented by including at least two gerotor pumps in the gerotor pump apparatus, wherein the at least two gerotor pumps are configured to function with an angular offset between their respective gerotors, and wherein the gerotor pump apparatus includes a data processing arrangement that is configured to sense the periodic pulses at the output port arrangement to generate a sensor signal and to process the sensor signal to generate a required value of the angular offset to be applied to the at least two gerotor pumps to apply the at least partially antiphase correction to attenuate the amplitude of the periodic pulses at the output port arrangement.

Optionally, for the gerotor pump apparatus, the pulse attenuating arrangement is implemented by including an actuator coupled to vibrate a diaphragm in fluid communication with fluid present in use at the output port arrangement, wherein the gerotor pump apparatus further includes a data processing arrangement that is configured to sense the periodic pulses at the output port arrangement to generate a sensor signal and to process the sensor signal to generate a drive signal to excite the actuator to apply the at least partially antiphase correction to attenuate the amplitude of the periodic pulses at the output port arrangement.

According to a another aspect, there is provided a gerotor pump including a pump head including a configuration of gerotors for pumping in operation a fluid medium from an input port arrangement to an output port arrangement, and a motor arrangement for providing mechanical power in operation for actuating the configuration of gerotors, wherein the configuration of gerotors includes an inner gerotor and an outer gerotor that are operable to cooperate to entrap and propel the fluid medium from the input port arrangement to the output port arrangement, at least one of the outer gerotor and the inner gerotor are fabricated from a flexible material and/or are internally structured so as to exhibit a flexible peripheral exterior surface in operation, and the outer gerotor and the inner gerotor are loaded and/or are assembled together in a preloaded state, within the pump head, so that a gap formed between the gerotors whereat they mutually cooperate for entrapping and propelling the fluid medium is maintained in a flexibly compressed state when the pump is in operation.

Optionally, in respect of the pump, at least one of the outer and inner gerotors is fabricated from stainless steel or polyether ether ketone. However, it will be appreciated that other materials can be used to fabricate the gerotors, for example as elucidated later in the present disclosure.

Optionally, in respect of the pump, at least one of the outer and inner gerotors is fabricated as a hybrid component including regions of a flexible (namely, relatively more flexible) material therein, and regions of an inflexible material (namely, relatively less flexible) therein. More optionally, in respect of the pump, the flexible material has a Young's modulus in a range of 0.5 MegaPascals (MPa) to 300 GigaPascals (GPa), and the inflexible material has a Young's modulus in a range of 2 GPa to 1 TPa. Yet more optionally, in respect of the pump, the flexible material has a Young's modulus in a range of 1 MegaPascal (MPa) to 5 GigaPascals (GPa), and the inflexible material has a Young's modulus in a range of 2 GPa to 420 GPa.

Optionally, the pump includes a motor arrangement coupled to provide mechanical power for driving at least one of the inner gerotor and the outer gerotor for pumping the fluid medium, wherein the motor arrangement includes at least one motor having a rotor and stator, with a motor cavity defined between the rotor and the stator, wherein the pump is operable to direct the fluid medium via the motor cavity when pumping the fluid medium from the input port arrangement to the output port arrangement.

Optionally, in respect of the pump, the motor arrangement is arranged to operate such that the fluid medium passing through the motor cavity is operable to cool the motor.

Optionally, in respect of the pump, the fluid medium is directed in operation through the motor cavity so as to reduce formation of stagnant regions of the fluid medium that are prone to sedimenting or coagulating.

More optionally, in respect of the pump, a spatial variation of flow rate of the fluid medium through regions of the motor cavity is within a range of 10% to 90% of a corresponding aggregated flow rate of the fluid medium through the motor cavity. Yet more optionally, in respect of the pump, the spatial variation of flow rate of the fluid medium through the regions of the motor cavity is within a range of 30% to 70% of a corresponding aggregated flow rate of the fluid medium through the motor cavity.

Optionally, in respect of the pump, the motor arrangement includes a cooling arrangement for extracting heat generated in the motor arrangement during operation, so that power dissipation occurring in the motor arrangement during operation does not cause heating of the fluid medium when output from the output port arrangement. More optionally, in respect of the pump, the cooling arrangement includes a Peltier cooling element.

Optionally, in respect of the pump, the motor arrangement includes at least one of: a synchronous motor, a switched reluctance motor, a stepper motor, an induction motor, a DC motor.

Optionally, in respect of the pump, at least one of the inner gerotor and the outer gerotor are fabricated, at least in part, from a flexible material, and/or are shaped internally so as to exhibit peripheral flexibility, and are held under tension together during operation to close a gap therebetween that is operable to transport, by viscous drag and entrapment, the fluid medium from the input port arrangement to the output port arrangement.

Optionally, in respect of the pump, the inner gerotor and outer gerotor are manufactured using at least one of: casting, milling, turning, grinding, lapping, superfinishing, physical vapour deposition, 3-D printing techniques, chemical vapour deposition, sintering, laser ablation machining, spark erosion.

Optionally, in respect of the pump:

(i) the motor arrangement includes a sensing arrangement to monitor an angular position of a drive shaft of at least one motor that is used in operation for providing the mechanical power to the pump head; and (ii) the pump includes a data processing arrangement to receive an angle-indicative signal or a rotation-rate indicative signal from the sensing arrangement, and to control electrical power applied to the at least one motor, for controlling pumping of the fluid medium from the input port arrangement to the output port arrangement.

More optionally, in respect of the pump, the motor arrangement is provided with a torque-sensing arrangement for generating a signal indicative of torque applied to the shaft in operation, and the data processing arrangement is operable to apply an angular correction to the angle-indicative signal or the rotation-rate indicative signal to compensate for angular flexure of the drive shaft and the gerotors when the pump is operable to pump the fluid medium from the input port arrangement to the output port arrangement.

According to another aspect, there is provided an apparatus including a pump of the first aspect to provide a flow of a fluid medium, wherein the apparatus further includes a Bernoulli-effect separator for receiving the flow from the pump to separate components of the flow into a plurality of flow paths depending upon densities or masses of the components.

According to another aspect, there is provided a method for (namely, a method of) producing a gerotor pump including a pump head including a configuration of gerotors for pumping in operation a fluid medium from an input port arrangement to an output port arrangement, and a motor arrangement for providing mechanical power in operation for actuating the configuration of gerotors, wherein the method includes:

(i) arranging for the configuration of gerotors to include an outer gerotor and an inner gerotor that are operable to cooperate to entrap and propel the fluid medium from the input port arrangement to the output port arrangement;

(ii) fabricating at least one of the outer gerotor and the inner gerotor from a flexible material and/or are internally structured so as to exhibit a flexible peripheral exterior surface in operation; and (iii) loading and/or assembling together in a preloaded state the outer gerotor and the inner gerotor, within the pump head, so that a gap for entrapping and propelling the fluid medium formed whereat the gerotors mutually cooperate is maintained in a flexibly compressed state when the pump is in operation.

Optionally, the method includes assembling the gerotors in a preloaded state by including an expansion tool between the gerotors mounted into the pump head, and then removing the expansion tool.

Optionally, the method includes assembling the gerotors in a preloaded state by including linear guiding between the gerotors mounted into the pump head, and then removing the linear guiding. Optionally, the linear guiding is provided using removable shimming or similar.

Optionally, the method includes manufacturing the inner gerotor and outer gerotor by using at least one of: casting, milling, turning, grinding, lapping, superfinishing, physical vapour deposition, 3-D printing techniques, sintering, laser ablation machining, spark erosion.

More optionally, the method includes coupling a motor arrangement to provide mechanical power for driving at least one of the inner gerotor and the outer gerotor for pumping the fluid medium, wherein the motor arrangement includes at least one motor having a rotor and stator, with a motor cavity defined between the rotor and the stator, wherein the pump is operable to direct the fluid medium via the motor cavity when pumping the fluid medium from the input port arrangement to the output port arrangement.

More optionally, the method includes arranging the motor arrangement to operate such that the fluid medium passes through the motor cavity in operation to cool the motor.

Optionally, the method includes arranging for the fluid medium to be directed in operation through the motor cavity to reduce formation of stagnant regions of the fluid medium that are prone to sedimenting or coagulating. More optionally, the method includes arranging for the spatial variation of flow rate of the fluid medium through regions of the motor cavity is within a range of 10% to 90% of a corresponding aggregated flow rate of the fluid medium through the motor cavity. Yet more optionally, the method includes arranging for the spatial variation of flow rate of the fluid medium through the regions of the motor cavity is within a range of 30% to 70% of a corresponding aggregated flow rate of the fluid medium through the motor cavity.

More optionally, the method includes arranging for the motor arrangement to include a cooling arrangement for extracting heat generated in the motor arrangement during operation, so that power dissipation occurring in the motor arrangement during operation does not cause heating of the fluid medium when output from the output port arrangement. More optionally, the method includes arranging for the cooling arrangement to include a Peltier cooling element.

More optionally, the method includes arranging for the motor arrangement to include at least one of: a synchronous motor, a switched reluctance motor, a stepper motor, an induction motor, a DC motor.

More optionally, the method includes fabricating at least one of the inner gerotor and the outer gerotor, at least in part, from a flexible material, and/or shaping them internally so as to exhibit peripheral flexibility, and are held under tension together during operation to close a gap therebetween that is operable to transport, by viscous drag and entrapment, the fluid medium from the input port arrangement to the output port arrangement.

More optionally, the method includes:

(i) including a sensing arrangement in the motor arrangement to monitor an angular position of a drive shaft of at least one motor that is used in operation for providing the mechanical power to the pump head; and (ii) including a data processing arrangement in the pump that receives an angle-indicative signal or a rotation-rate indicative signal from the sensing arrangement, and that controls electrical power applied to the at least one motor, for controlling pumping of the fluid medium from the input port arrangement to the output port arrangement.

Yet more optionally, the method includes:

(i) providing the motor arrangement with a torque-sensing arrangement for generating a signal indicative of torque applied to the shaft in operation; and (ii) arranging for the data processing arrangement to apply an angular correction to the angle-indicative signal or the rotation-rate indicative signal to compensate for angular flexure of the drive shaft and the gerotors, when the pump is operable to pump the fluid medium from the input port arrangement to the output port arrangement.

Additional aspects, advantages, features and objects of the present disclosure would be made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those in the art will understand that the drawings are not to scale. Wherever possible, like elements have been indicated by identical numbers.

Embodiments of the present disclosure will now be described, by way of example only, with reference to the following diagrams wherein.

Figure 1:
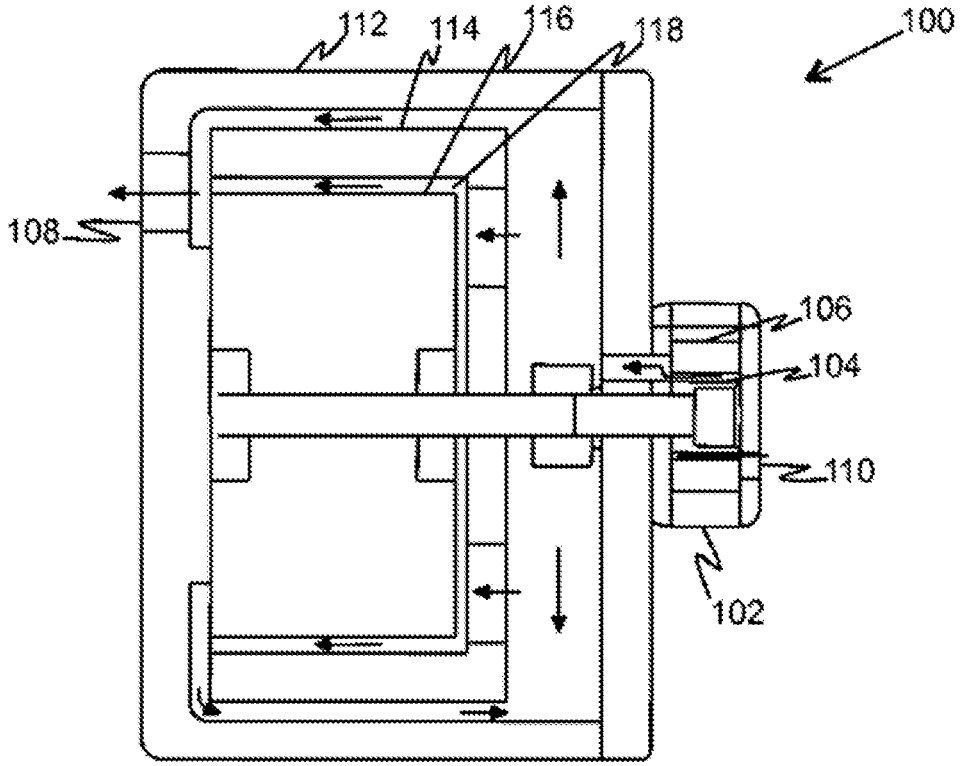
FIG. 1 is a schematic diagram of a pump, in accordance with an embodiment of the present disclosure.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION OF EMBODIMENTS

In the following detailed description, there are provided example embodiments of the present disclosure and ways in which they can be implemented. Although some modes of carrying out the present disclosure have been described, those skilled in the art would recognize that other embodiments for carrying out or practicing the present disclosure are also possible.

In one aspect, an embodiment of the present disclosure provides a pump including a pump head utilizing in operation one or more moveable components for pumping a fluid medium from an input port arrangement to an output port arrangement, and a motor arrangement coupled to the pump head for providing mechanical power for moving the one or more moveable components for pumping the fluid medium, wherein the motor arrangement includes at least one motor having a rotor and stator, with a motor cavity defined between the rotor and the stator, and the pump is operable to direct the fluid medium via the pump head and the motor cavity when pumping the fluid medium from the input port arrangement to the output port arrangement.

In another aspect, an embodiment of the present disclosure provides a method for (namely, a method of) producing a pump including a pump head utilizing in operation one or more moveable components for pumping a fluid medium from an input port arrangement to an output port arrangement, and a motor arrangement coupled to the pump head for providing mechanical power for moving the one or more moveable components for pumping the fluid medium, wherein the method includes arranging for the motor arrangement to include at least one motor having a rotor and stator, with a motor cavity defined between the rotor and the stator, and arranging for the pump to be operable to direct the fluid medium via the pump head and the motor cavity when pumping the fluid medium from the input port arrangement to the output port arrangement.

In yet another aspect, an embodiment of the present disclosure provides a method for (namely, a method of) operating a pump including a pump head utilizing in operation one or more moveable components for pumping a fluid medium from an input port arrangement to an output port arrangement, and a motor arrangement coupled to the pump head for providing mechanical power for moving the one or more moveable components for pumping the fluid medium, wherein the method includes arranging for the motor arrangement to include at least one motor having a rotor and stator, with a motor cavity defined between the rotor and the stator, and operating the pump to direct the fluid medium via the pump head and the motor cavity when pumping the fluid medium from the input port arrangement to the output port arrangement.

In an aspect, an embodiment of the present disclosure provides a gerotor pump including a pump head including a configuration of gerotors for pumping in operation a fluid medium from an input port arrangement to an output port arrangement, and a motor arrangement for providing mechanical power in operation for actuating the configuration of gerotors, wherein the configuration of gerotors includes an outer gerotor and an inner gerotor that are operable to cooperate to entrap and propel the fluid medium from the input port arrangement to the output port arrangement, at least one of the outer gerotor and the inner gerotor are fabricated from a flexible material (namely, relatively more flexible) and/or are internally structured so as to exhibit a flexible peripheral exterior surface in operation, and the outer gerotor and the inner gerotor are loaded and/or are assembled together in a preloaded state, within the pump head, so that a gap formed between the gerotors whereat they mutually cooperate for entrapping and propelling the fluid medium is maintained in a flexibly compressed state when the pump is in operation.

In another aspect, an embodiment of the present disclosure provides a method for (namely, a method of) producing a gerotor pump including a pump head including a configuration of gerotors for pumping in operation a fluid medium from an input port arrangement to an output port arrangement, and a motor arrangement for providing mechanical power in operation for actuating the configuration of gerotors, wherein the method includes:

(i) arranging for the configuration of gerotors to include an outer gerotor and an inner gerotor that are operable to cooperate to entrap and propel the fluid medium from the input port arrangement to the output port arrangement;

(ii) fabricating at least one of the outer gerotor and the inner gerotor from a flexible material and/or are internally structured so as to exhibit a flexible peripheral exterior surface in operation; and (iii) loading and/or assembling together in a preloaded state the outer gerotor and the inner gerotor, within the pump head, so that a gap for entrapping and propelling the fluid medium formed whereat the gerotors mutually cooperate is maintained in a flexibly compressed state when the pump is in operation.

In yet another aspect, an embodiment of the present disclosure provides a pump including a pump head utilizing in operation one or more moveable components for pumping a fluid medium from an input port arrangement to an output port arrangement, and a motor arrangement coupled to the pump head for providing mechanical power for moving the one or more moveable components for pumping the fluid medium, wherein the motor arrangement includes a sensing arrangement for monitoring an angular position of a drive shaft of at least one motor that is used in operation for providing the mechanical power to the pump head, and the pump includes a data processing arrangement for receiving an angle-indicative signal or a rotation-rate indicative signal from the sensing arrangement, and controlling electrical power applied to the at least one motor, for controlling pumping of the fluid medium from the input port arrangement to the output port arrangement.

The pump includes a pump head utilizing in operation one or more movable components for pumping a fluid medium from an input port arrangement to an output port arrangement. The pump may be operable to pump (or transport) the fluid medium by mechanical action of the movable components. In an example, the mechanical action may be reciprocating or exhibit a rotary action. Moreover, the pump may be operable to entrap (or suck) the fluid medium received at the input port arrangement and dispense (or pump) the fluid medium to the output port arrangement. In an embodiment, the fluid medium includes a liquid that is capable of flowing. In an example, the liquid may be water, oil, paint, grease, fuel, liquid waste, and so forth. However, it will be appreciated that, with suitably rapidly rotating components, the fluid medium pumped (or sucked) can be a gas. Furthermore, the pump head may include a housing that is configured (namely, suitably fabricated in manufacture) to accommodate the movable components of the pump. In an example, the pump head may be configured to have a cylindrical shape. Optionally, the pump head may be configured to have a cuboidal shape. Moreover, the pump head may be made of a suitable material such as plastics material, flexible polymer such as rubber, metal, ceramic or any combination thereof. Furthermore, the pump head may include a cavity, such as a pump cavity, between the movable components of the pump and the pump head.

In one embodiment, the pump head may comprise the input port arrangement and the output port arrangement at the same side of the pump head. For example, the input port arrangement and the output port arrangement may be disposed on the front side of the pump head. Alternatively, the pump head may comprise the input port arrangement and the output port arrangement at the opposite sides of the pump head. According to an embodiment, the input port arrangement and the output port arrangement may be respectively coupled to conduits (such as pipes). In such instance, the conduit coupled to the input port arrangement may enable transport of the fluid medium to the input port arrangement from a holding area (such as a tank) to be pumped. Moreover, the conduit coupled to the output port arrangement may transport the pumped fluid medium from the output port arrangement to the intended destination thereof.

The pump further includes a motor arrangement coupled to the pump head for providing mechanical power for moving the one or more movable components for pumping the fluid medium. The motor arrangement includes at least one motor having a rotor and stator, with a motor cavity defined between the rotor and the stator. The motor may be an electric motor that is capable of converting electrical power to mechanical power. Moreover, the motor includes a rotor that is a rotating part of the motor, and a stator that is a stationary part of the motor. Furthermore, the rotor and stator may be separated by a distance, comprising the motor cavity. Additionally, the rotor and stator may be supported and covered by a motor housing. In an example, the stator may be configured to have cylindrical shape with a smaller diameter compared to the motor housing, such that the stator can be housed within the motor housing. In an embodiment, the stator is an electromagnet, consisting of windings supported over a cylindrical frame. The windings may be made of copper. Optionally, the windings may be made of a material with higher electrical conductivity than copper. Furthermore, the stator may include metallic and/or alloy laminations to reduce energy losses. Additionally, the rotor may be configured to have a cylindrical shape with a smaller diameter compared to the stator, such that the rotor can be covered by the stator. In an example, the rotor may be a permanent magnet. It may be evident that the rotor rotates under the influence of magnetic field, through an interaction between magnetic field thereof and magnetic field (opposite in nature) produced by current flowing through the windings of the stator. In one embodiment, at least one of the rotor and the stator may be encapsulated in a protective covering for reducing viscous drag by flow of the fluid medium through the motor arrangement. In an example, the protective covering may be made of a resin and may further have a smooth cylindrical shape. In another example, the protective covering may comprise a smooth cylindrical can that is made of a non-magnetic material, such as non-ferromagnetic stainless steel. According to an embodiment, the motor cavity (such as the gap between the stator and the rotor) may be of greater size compared to conventional pumps for optimising the viscous drag caused by flow of the fluid medium through the motor arrangement.

In an embodiment, the motor further includes a drive shaft that is operatively coupled to the rotor. In operation, the rotor rotates the drive shaft and the rotation thereof is provided as mechanical power for moving the one or more movable components for pumping the fluid medium. According to an embodiment, at least one of the movable components of the pump may have an opening to accommodate the drive shaft. In such instance, the shape of the drive shaft may be complementary to the opening in the movable component. In an example, the drive shaft may be a cylindrical shaft complementary to a cylindrical (or circular) opening in the movable component. In another example, the drive shaft may have a cuboidal shape complementary to a cuboidal (or square) opening in the movable component.

According to an embodiment, the pump head comprises a pump cylinder, a front (or outer) face and a back (or inner) face. The pump cylinder may be a cylindrical housing that forms the substantial portion of the pump head. Furthermore, the pump cylinder may comprise the middle portion of the pump head. In an example, the pump cylinder may be a hollow cylinder. The front face and the back face of the pump head may be circular plates that are coupled to the pump cylinder. In an example, the front face comprises the input port arrangement and the output port arrangement as openings therein. In another example, the back face comprises an opening to accommodate the drive shaft. In yet another example, a shape of the opening in the back face may be circular.

In one embodiment, the pump head and its one or more movable components are implemented as a gerotor pump, having an outer gerotor and an inner gerotor disposed in operation inside the outer gerotor, wherein rotation of the gerotors by the mechanical power provided by the motor arrangement is operable to cause the gerotors to cooperate to entrap and propel the liquid medium from the input port arrangement to the output port arrangement. The gerotor pump is a positive displacement pump that is operable to pump a constant volume of the fluid medium in each cycle of its operation. The gerotor pump comprises the inner gerotor that is disposed (or positioned) in an outer gerotor. In one embodiment, the inner gerotor may be operatively coupled to the drive shaft for transmission of mechanical power from the motor arrangement to the inner gerotor. In such instance, it may be evident that the inner gerotor may be adapted to rotate within the outer gerotor. For example, the inner gerotor may be disposed within the outer gerotor such that an axis of rotation of the inner gerotor is eccentric to a central axis of the outer gerotor.

In one embodiment, a spiral spoke arrangement may be coupled to the drive shaft. In an example, such an arrangement may comprise radially distributed spiral spokes around the drive shaft. In such an embodiment, the spiral spoke arrangement may enable spatial distribution of torsion on the drive shaft and may also accommodate radial flexion of the inner gerotor during rotation thereof. In an embodiment, at least one of the gerotors may be epitrochoidal in shape. Alternatively, at least one of the gerotors may be hypotrochoidal in shape.

In an embodiment, the inner gerotor has a radius (such as pitch circle radius) in a range of 2 to 90 millimetres (mm) and rotor height in the range of 2 mm to 45 mm. For example, the radius of the inner gerotor may be 5 mm, 25 mm or 75 mm and may have rotor height of 6 mm, 18 mm or 22 mm. In another embodiment, the outer gerotor has a radial wall thickness in a range of 1 to 25 mm and rotor height in the range of 2 mm to 45 mm. In an example, the radial wall thickness of the outer gerotor may be 3 mm, 12 mm or 20 mm and may have rotor height of 6 mm, 18 mm or 22 mm. In one embodiment, the front face may have height in the range of 1 mm to 15 mm. For example, front face may have height of 2 mm, 4 mm or 5 mm. In one embodiment, the back face may have height in the range of 1 mm to 15 mm. For example, back face may have height of 2 mm, 4 mm or 5 mm.

According to an embodiment, at least one of the outer and inner gerotors are fabricated (namely, manufactured), at least in part, from a flexible material, and/or are shaped internally so as to exhibit peripheral flexibility, and are held under tension together during operation to close a gap therebetween that is operable to transport, by viscous drag and entrapment, the fluid medium from the input port arrangement to the output port arrangement. Typically, a gap is included between the inner gerotor and the outer gerotor. In such an implementation, the gap induces carryover, namely the fluid medium entrapped between the inner and outer gerotors is not completely pumped (or carried) further. In an embodiment, the outer gerotor is shaped such that the inner radius thereof is slightly smaller than the outer radius of the inner gerotor that is operable to mesh with the outer gerotor. In such an implementation, it will be appreciated that the inner radius of the outer gerotor forms a negative gap with the outer radius of the inner gerotor, such as, a negative difference of the inner radius of the outer gerotor and the outer radius of the inner gerotor. In one embodiment, the outer gerotor is fabricated (namely, manufactured) from a flexible material so as to exhibit peripheral flexibility to be arranged on the inner gerotor. In such instance, the outer gerotor may be subjected to slight expansion for assembly (or preloading) thereof onto the inner gerotor. Subsequently, during operation of the gerotor pump, the outer gerotor may be operable to compress the inner gerotor due to the outer gerotor returning to its original size. In such an implementation, the gap formed between the outer gerotor and the inner gerotor is reduced. In an example, there may be no clearance between the outer gerotor and the inner gerotor. Furthermore, in each cycle of its operation, the mating of the inner gerotor with the outer gerotor is operable to entrap a constant volume of the fluid medium by expansion of gap therebetween. In such an implementation, the fluid medium is entrapped by creation of suction at the input port arrangement. Subsequently, during end of each cycle of operation, compression of gap between the inner gerotor and the outer gerotor is operable to pump the entrapped fluid medium from the output port arrangement. It will be appreciated that, in such an implementation, an entirety of the fluid medium is pumped (by viscous drag and entrapment thereof) from the input port arrangement to the output port arrangement.

The gerotor pump (such as the pump implemented as a gerotor pump, described hereinabove) includes a pump head including a configuration of gerotors for pumping in operation a fluid medium from an input port arrangement to an output port arrangement, and a motor arrangement for providing mechanical power in operation for actuating the configuration of gerotors. The configuration of gerotors includes an outer gerotor and an inner gerotor that are operable to cooperate to entrap and propel the fluid medium from the input port arrangement to the output port arrangement. Furthermore, at least one of the outer gerotor and the inner gerotor are fabricated from a flexible material and/or are internally structured so as to exhibit a flexible peripheral exterior surface in operation. The outer gerotor and the inner gerotor are loaded and/or are assembled together in a preloaded state, within the pump head, so that a gap formed between the gerotors whereat they mutually cooperate for entrapping and propelling the fluid medium is maintained in a flexibly compressed state when the pump is in operation. In an example, the inner radius of the outer gerotor is slightly smaller than the outer radius of the inner gerotor. In such an implementation, the inner gerotor may be slightly compressed (or elastically distorted) for assembly thereof with the outer gerotor. Furthermore, the sliding contact points between the inner gerotor and the outer gerotor whereat the mutually cooperate for entrapping and propelling the fluid medium may be preloaded in close contact. Furthermore, a close contact achieved between the contact points between the inner gerotor and the outer gerotor may enable a tight seal after wear (such as, from prolonged use of the pump), dimensional instability of the movable components of the pump (for example, due to thermal or chemical changes therein), manufacturing imperfections (such as errors in size and/or form thereof), and so forth. During operation, the compressed inner gerotor may return to its original size, thereby maintaining the gap between the inner gerotor and the outer gerotor in a compressed state. Furthermore, usage of a flexible material for fabrication of (namely, manufacture of) at least one of the inner gerotor and/or the outer gerotor may enable the gap to be maintained in a flexibly compressed state (i.e. in operation, the gap may be allowed to expand to its original size and alternately return to a compressed state).

In an embodiment, the motor arrangement includes at least one of a synchronous motor, a switched reluctance motor, an induction motor, a stepper motor and/or a DC motor. In an example, the motor arrangement includes a synchronous motor, such as a brushless AC motor or a brushless DC motor. In yet another example, the motor arrangement includes a synchronous motor, such as a stepper motor. In such instance, during each step of the stepper motor, the gap formed between the gerotors may expand due to rotation of the inner gerotor from a completely meshed position of the inner gerotor with the outer gerotor to an unmeshed position. In such an implementation, the fluid medium that was entrapped in the previous gap between the gerotors may be propelled to a subsequent gap due to closing of the gap (such as, due to meshing of the gerotors). Similarly, during a further step of the stepper motor, the fluid medium entrapped in the subsequent gap may be propelled in entirety still further to the next gap, due to closing of the subsequent gap. In an embodiment, at least one of the outer and inner gerotors is fabricated from stainless steel or polyether ether ketone (PEEK).

In another embodiment, at least one of the outer and inner gerotors is fabricated (namely, manufactured) from an elastic material. In an example, the elastic material may be a Nickel-Titanium alloy. In yet another embodiment, at least one of the outer and inner gerotors is fabricated from fatigue and/or wear resistant material. In an example, the fatigue resistant material may be a ceramic.

In another embodiment, at least one of the outer and inner gerotors is fabricated (namely, manufactured) as a hybrid component including regions of a flexible (namely, relatively more flexible) material therein, and regions of an inflexible (namely, relatively less flexible) material therein. In an example, at least one of the outer and inner gerotor may be fabricated using rigid stainless steel with fluoroelastomer inserts. In one example, at least one of the outer and inner gerotors may be fabricated as a hybrid component using an overmoulding process. In such instances, the flexible material included in at least one of the outer and inner gerotor may allow elastic deformation at contact points (such as, during meshing) therebetween while rigidly maintaining the shape of at least one of the outer and inner gerotor.

According to an embodiment, the flexible material has a Young's modulus in a range of 1 MegaPascal (MPa) to 5 GigaPascals (GPa), and the inflexible material has a Young's modulus in a range of 2 GPa to 420 GPa.

In one embodiment, the one or more movable components of the pump arrangement are manufactured (namely, fabricated) using machining, casting and/or 3-D printing techniques. In an example, the one or more movable components of the pump arrangement may be manufactured (namely, fabricated) using a 3-D printing technique such as selective laser melting (SLM). In another example, the one or more movable components of the pump arrangement may be fabricated (namely, manufactured) from polyether ether ketone (PEEK) using a 3-D printing technique such as selective light activation (SLA) or selective laser sintering (SLS).

The pump is operable to direct the fluid medium via the pump head and the motor cavity when pumping the fluid medium from the input port arrangement to the output port arrangement. The pump head may be operatively coupled to the motor housing such that the fluid medium that is introduced to the input port arrangement flows through the pump cavity, the motor cavity (formed by the motor housing) and is subsequently pumped out of the output port arrangement.

According to an embodiment, the motor arrangement is arranged to operate such that the fluid medium passing through the motor cavity is operable to cool the motor. For example, the motor may generate heat during operation thereof due to flow of electricity through the windings of the stator, and/or due to friction (such as viscous drag) between the rotor and the fluid medium. In such an implementation, the fluid medium (such as oil) may be operable to cool the motor by transferring heat from components of the motor to the fluid medium. It will be appreciated that, in such an implementation, the temperature of the fluid medium is lower than the temperature of the motor to enable a temperature difference for transfer of heat from high-temperature heat source to low-temperature heat sink.

In another embodiment, the motor arrangement includes a cooling arrangement for extracting heat generated in the motor arrangement during operation so that power dissipation occurring in the motor arrangement during operation does not cause heating (for example, less than 10° C. heating, more optionally less than 2° C. heating, and yet more optionally less than 0.5° C. heating) of the fluid medium when output from the output port arrangement. In one embodiment, the cooling arrangement includes a Peltier cooling element. The Peltier cooling element may be a thermoelectric heat pump that is configured to employ the Peltier effect for removing heat from the motor arrangement. In an example, the Peltier cooling element may be operatively coupled to the stator for removing heat therefrom. In another example, the motor arrangement includes a switched reluctance motor that comprises windings on the stator that is provided with current. In such an implementation, the rotor of the motor arrangement does not comprise windings or magnets. In such instance, the heat is primarily generated by the stator and is therefore, coupled with a Peltier cooling element to remove heat therefrom.

According to an embodiment, the fluid medium is directed in operation through the motor cavity and the pump head so as to reduce formation of stagnant regions of the fluid medium that are prone to sedimenting or coagulating. The fluid medium that is directed in operation through the motor cavity and the pump head enables elimination of a dead space (such as the motor cavity and/or space between the pump head and the movable components thereof) therein. Such a flow of the fluid medium reduces a formation of stagnant regions thereof, for example, by solidification (by sedimenting or coagulating) of the fluid medium. In such an implementation, seizure of the motor arrangement due to jamming of the solidified fluid medium with the rotor and/or stator may be avoided. Furthermore, such flow of the fluid medium through the motor cavity and the pump head may enable cleaning of the pump by introduction of a different fluid medium therein. For example, flow of fluid medium through the pump may enable priming (such as removal of air from the pump) of the pump by pumping of a fluid medium (such as water) through the motor cavity and the pump head. Optionally, the fluid medium (such as oil) that is directed in a narrow cavity (such as the cavity between the drive shaft and a bearing) may enable creation of a fluid bearing effect therein.

In the pump, the fluid medium is directed in operation through the motor cavity so as to reduce formation of stagnant regions of the fluid medium that are prone to sedimenting or coagulating; such a direction of the fluid medium is achieved by shaping the motor cavity to maintain a more uniform variation of flow in various spatial regions of the motor cavity; for example, narrow regions that would otherwise be accommodating a relatively low fluid medium flow rate in operation are avoided by making the narrow regions of a broader, more open profile. For example, optionally, the spatial variation of flow rate of the fluid medium through regions of the motor cavity is within a range of 10% to 90% of a corresponding aggregated flow rate of the fluid medium through the motor cavity. For example, yet more optionally, in respect of the pump, the spatial variation of flow rate of the fluid medium through the regions of the motor cavity is within a range of 30% to 70% of a corresponding aggregated flow rate of the fluid medium through the motor cavity. The aggregated flow rate corresponds to a total flow rate of the fluid medium through the motor cavity. However, it will be appreciated that the flow of the fluid medium is zero immediately at an interface to a solid surface of the motor cavity, such that aforementioned flow rates pertain to a distance of more than a millimetre from a solid surface of the motor cavity.

A tendency for sedimentation or coagulation of fluid media to occur in the pump is susceptible to being reduced by a plurality of approaches:

(i) by reducing, for example by transforming or eliminating, by design "dead ends" in passages of the motor cavity and pump head, namely spatial regions with only one entrance thereto, into flow paths for the fluid media, for example by placing one of the ports of the pump on a far end of the motor cavity from the pump head, for example as illustrated in FIG. 1, instead of having both inlet and outlet ports at the pump head;

(ii) by reducing, for example minimizing, changes in a cross-sectional area of a given flow of the fluid media, so as to try to maintain as constant a flow velocity of the fluid media that transported through the pump; (iii) by reducing sharp or abrupt corners in a flow path of the fluid media transported through the pump, for example by employing smooth gradual changes in flow direction and flow path cross-section;

(iv) by reducing a tendency for a flow path of the fluid media to recirculate, by reducing or avoiding flow path cycles or return paths; such an approach is especially relevant when the fluid media transported through the pump have a strictly limited lifetime, for example fluid media that are experiencing a chemical reaction as they are transported through the pump (for example polymerizing plastics materials and similar).

In one embodiment, the pump comprises a channel from a high-pressure side of the pump to a low-pressure side of the pump. Such a channel may allow creation of a pressure differential for flow of fluid medium from the high-pressure side of the pump to the low-pressure side of the pump, thereby reducing (or flushing) the dead space in the pump. Furthermore, such a flow of the fluid medium through channels (or narrow gaps) in the pump may enable creation of a fluid bearing effect in the pump.

In an embodiment, the fluid medium is pumped to a gap such as the pump cavity. Furthermore, a flow of the fluid medium through the pump cavity may enable flushing of the gap and may also enable creation of a fluid bearing effect between the outer gerotor and the pump head. Additionally, such flow of the fluid medium may reduce tension on the outer gerotor that may be caused due to differential pressure in the pump and may further reduce a chance of pump failure due to the differential pressure.

In another embodiment, the pump comprises a channel on the inner surface of the front face to the back face. In such an implementation, the fluid medium flows to a space between the inner gerotor and the drive shaft (through the opening on the back face), thereby creating a fluid bearing effect therebetween. Furthermore, such a channel may also enable a flow of the fluid medium between the drive shaft and the opening on the back face, thereby flushing the gap therebetween. In another embodiment, the pump comprises an additional channel that is coupled in parallel to the pump for partially transporting of the fluid medium using the channel. Such a channel may enable a reduction of viscous drag by the fluid medium on the movable components of the pump. In one embodiment, a valve arrangement may be coupled to the channel for controlling a flow of the fluid medium therethrough. In an example, the valve arrangement may comprise a check valve, such as a ball check valve.

The pump (such as the pump described hereinabove) includes a pump head utilizing in operation one or more movable components for pumping a fluid medium from an input port arrangement to an output port arrangement, and a motor arrangement coupled to the pump head for providing mechanical power for moving the one or more movable components for pumping the fluid medium. The motor arrangement further includes a sensing arrangement for monitoring an angular position of a drive shaft of at least one motor that is used in operation for providing the mechanical power to the pump head. In an embodiment, the sensor arrangement is a magnetic sensor, such as a Hall Effect array, an electrostatic (or capacitive) sensor, an optical sensor, an inductive sensor, or a mechanical sensor. In an example, the sensor arrangement is a magnetic sensor that is operable to sense the rotation of an annular magnet coupled to the drive shaft, and to generate an output signal corresponding to the angular position of the drive shaft. Furthermore, the sensor is configured, namely operable, to generate the output signal in the form of a Hall Effect voltage in response to the rotation of the drive shaft (or the annular magnet coupled thereto).

The pump further includes a data processing arrangement for receiving an angle-indicative signal or a rotation-rate indicative signal from the sensing arrangement, and controlling electrical power applied to the at least one motor, for controlling pumping of the fluid medium from the input port arrangement to the output port arrangement. The data processing arrangement is operatively coupled to the sensing arrangement for receiving the output signal therefrom. The data processing arrangement may be further associated with a plurality of electronic components such a microcontroller, a power source, a memory, an antenna and so forth. In an example, the data processing arrangement may comprise a servo-controller (such as, a controller of the motor). In such an implementation, the data processing arrangement may be configured to control the electrical power applied to the motor based on the received angle-indicative signal or a rotation-rate indicative signal to ensure that an accurate volume of fluid medium is pumped from the input port arrangement to the output port arrangement. It will be appreciated that, in such an implementation, the data processing arrangement is operatively coupled to an electrical power source of the motor, such that based on a control command from the data processing arrangement, a pre-determined amount of electrical power is provided to the motor from the electrical power source. Therefore, the drive shaft of the motor is operable to have a pre-determined amount of rotation based on the pre-determined amount of electrical power. This causes a predetermined volume of fluid to be pumped or dispensed by the motor based on the pre-determined amount of rotation of the drive shaft thereof.

In an embodiment, the motor arrangement is provided with a torque-sensing arrangement for generating a signal indicative of torque applied to the shaft in operation, and the data processing arrangement is operable to apply an angular correction to the angle-indicative signal or the rotation-rate indicative signal to compensate for angular flexure of the drive shaft and the gerotors when the pump is operable to pump the fluid medium from the input port arrangement to the output port arrangement. In an example, the data processing arrangement may be operable to compare the signal indicative of sensed torque applied to the shaft provided by the torque sensing arrangement with the angle-indicative signal or the rotation-rate indicative signal. In an instance when a difference therebetween is identified, the data sensing arrangement may be operable to apply an angular correction to the angle-indicative signal or the rotation-rate indicative signal to compensate for angular flexure of the drive shaft and the gerotors when the pump is operable to pump the fluid medium from the input port arrangement to the output port arrangement. Furthermore, this may enable the pump to pump a more accurate volume of the fluid medium from the input port arrangement to the output port arrangement. As will be elucidated later in greater detail, the data processing arrangement is beneficially configured to control a plurality of gerotor pumps whose output ports are mutually coupled together in close spatial relationship to provide a common output port, wherein each gerotor pump includes a corresponding motor to provide torque to rotate its respective gerotors to pump a fluid through the gerotor pump, and the data processing arrangement is configured to synchronize rotations of rotors of the motors of the plurality of gerotor pumps with at least one adjustable angular offset therebetween, wherein the data processing arrangement is configured to execute an algorithm that adjusts the at least one adjustable angular offset to reduce pulsations occurring at the common output port. The at least one adjustable angular offset may be considered to be at least one adjustable phase shift between the rotors of the motors. The pulsations may be, for example, caused by mutual engagement and disengagement of gerotor teeth, wherein the gerotors are driven by the rotors of the motors. By using such an approach, the plurality of gerotor pumps are capable of providing an extremely fast response to changes in required flow rate of fluid at the common output port, whilst providing a reduced degree of pulsations in the flow of fluid at the common output port; such improvement is achieved without needing to use a smoothing reservoir. Optionally, the plurality of gerotor pumps is implemented as two gerotor pumps, for example a matched pair of gerotor pumps. The aforesaid algorithm is beneficially configured to determine the required at least one angular offset by executing a steady-flow-state pulsation calibration routine in which the at least one angular offset is determined in an iterative manner to identify one or more values of the at least one angular offset at which amplitudes of pulsations are reduced, for example the amplitudes of pulsations are minimized; subsequently, when in normal operation, the one or more values of the at least one angular offset are applied to the motors. Optionally, the one or more values of the at least one angular offset is determined for a range of different fluid flow rates provided at the common output port, wherein the one or more values of at least one angular offsets applied to control the plurality of gerotor pumps are varied as a function of the fluid flow rate through the plurality of gerotor pumps; in other words, the at least one angular offset applied by the algorithm to suppress pulsations at the common output port is dynamically varied as a function of the fluid flow provided at the common output port. The calibration routine is beneficially used on a periodic basis to recalibrate the plurality of gerotor pumps, for example during maintenance work implemented on the plurality of gerotor pumps, to ensure optimal performance of the gerotor pumps.

As an alternative or addition to using the plurality of gerotor pumps coupled to the common output port, a given gerotor pump may be provided at its output port with an actuator that is configured to move a diaphragm, wherein one side of the diaphragm that is remote from the actuator is configured to be in fluid communication with the output port and fluidically sealed thereto. The actuator is beneficially implemented as an electro-magnetic actuator or a piezo-electric stack actuator, or a combination of both. The output port is also provided with a pressure sensor for sensing pulsations occurring in operation at the output port. There is also provided a data processing arrangement, for example implemented as a microcontroller, for receiving an output signal from the pressure sensor and processing the output signal, for example using Fast Fourier Transform (FFT) processing, to generate an antiphase signal that is applied to the actuator to reduce an amplitude of the pulsations at the output port, for example to minimize the pulsations thereat. Optionally, the data processing arrangement is configured to implement a proportional-integral-differential (PID) control algorithm, wherein corresponding PID coefficients used are optionally dynamically varied as a function of fluid flow provided at the output port, to ensure optimal suppression of pulsations at the output port. As aforesaid, the pulsations may arise from engagement and disengagement of gerotor teeth of the pump as its associated gerotors rotate to pump fluid.

The method of producing a pump (such as the pump disclosed hereinabove) including a pump head utilizing in operation one or more moveable components for pumping a fluid medium from an input port arrangement to an output port arrangement, and a motor arrangement coupled to the pump head for providing mechanical power for moving the one or more moveable components for pumping the fluid medium, includes arranging for the motor arrangement to include at least one motor having a rotor and stator, with a motor cavity defined between the rotor and the stator, and arranging for the pump to be operable to direct the fluid medium via the pump head and the motor cavity when pumping the fluid medium from the input port arrangement to the output port arrangement.

The method of producing a gerotor pump including a pump head including a configuration of gerotors for pumping in operation a fluid medium from an input port arrangement to an output port arrangement, and a motor arrangement for providing mechanical power in operation for actuating the configuration of gerotors, includes arranging for the configuration of gerotors to include an outer gerotor and an inner gerotor that are operable to cooperate to entrap and propel the fluid medium from the input port arrangement to the output port arrangement. According to an embodiment, the pump cavity may be increased for better sliding of the outer gerotor against the pump head. In one example, a bore diameter of the gerotor cylinder may be increased relative to the external radius of the outer gerotor. In such instance, friction between the outer gerotor and the gerotor cylinder may be reduced. In another example, the increased size of pump cavity may enable better entrapment of the fluid medium in the pump cavity, thereby creating a hydrodynamic lubrication layer thereat. In such instance, an outer profile of the outer gerotor may be modified to promote formation of the hydrodynamic lubrication layer.

The method includes fabricating (namely, manufacturing) at least one of the outer gerotor and the inner gerotor from a flexible material and/or are internally structured so as to exhibit a flexible peripheral exterior surface in operation. In one embodiment, the method includes fabricating at least one of the outer gerotor and the inner gerotor using sections of a flexible material (such as stainless steel). For example, the sections may include thin corrugations of the flexible material. Furthermore, the sections may be assembled radially to fabricate at least one of the outer gerotor and the inner gerotor. Alternatively, the sections may be assembled axially. Optionally, the sections may be assembled both radially and axially to fabricate (namely, manufacture) at least one of the outer gerotor and the inner gerotor. In another embodiment, at least one of the outer gerotor and the inner gerotor are internally structured so as to exhibit a flexible peripheral exterior surface in operation. For example, the outer gerotor or the inner gerotor may comprise a channel on at least one face (such as the top face or the bottom face) thereof to increase elasticity of the gerotor along the axis thereof.

The method further includes tensioning and/or assembling together in a preloaded state the outer gerotor and the inner gerotor, within the pump head, so that a gap for entrapping and propelling the fluid medium formed whereat the gerotors mutually cooperate is maintained in a flexibly compressed state when the pump is in operation. In an embodiment, the outer gerotor has a thin form. In an example, the outer gerotor has a radial wall thickness of substantially 1 mm, for example in a range of 0.5 mm to 2.0 mm. In such an implementation, the outer gerotor may be expanded by a small distance and subsequently assembled with the inner gerotor in a preloaded state. In one embodiment, the method includes assembling the gerotors in a preloaded state by including an expansion tool between the gerotors mounted into the pump head, and then removing the expansion tool. In an example, the expansion tool may be compressive shimming. In another example, the expansion tool may have a frustum shape (such as the shape of lower portion of a cone subsequent to cutting and removal of top portion thereof). Furthermore, the base of the expansion tool may have the same radius as the inner radius of the outer gerotor. In such an implementation, the expansion tool may be assembled onto the inner gerotor and thereafter, the outer gerotor may be assembled with the inner gerotor by placement of the outer gerotor on the expansion tool and suitable application of pressure thereon. In another embodiment, the outer gerotor has a thick form. For example, the outer gerotor has a radial thickness of substantially 5 mm, for example in a range 3 mm to 7 mm. In one embodiment, the internal gerotor has a thin form. In an example, the inner gerotor may have a radial thickness (such as thickness of radial wall) of substantially 1 mm, for example in a range of 0.5 mm to 2 mm. In such instance, the inner gerotor may be compressed by a small distance to be assembled with the outer gerotor. According to an embodiment, the method includes assembling the gerotors in a preloaded state by including linear guiding between the gerotors mounted into the pump head, and then removing the linear guiding. In an example, the linear guiding may comprise linear guide shafts. In such instance, the linear guide shafts may be assembled into the outer gerotor and the inner gerotor may be subsequently assembled into the outer gerotor by suitable application of pressure thereon. In another embodiment, the internal gerotor has a thick form. In one example, the inner gerotor may have a sufficient radial wall thickness to make it substantially rigid. For example, the inner gerotor may have a radial wall thickness of 3 mm.

DETAILED DESCRIPTION OF THE DRAWINGS

FIG. 1 is a schematic diagram of a pump 100, in accordance with an embodiment of the present disclosure. As shown, the pump 100 includes a pump head 102 utilizing in operation one or more moveable components 104, 106 for pumping a fluid medium from an input port arrangement 110 to an output port arrangement 108. The pump 100 further includes a motor arrangement 112 coupled to the pump head 102 for providing mechanical power for moving the one or more moveable components 104, 106 for pumping the fluid medium. The motor arrangement 112 includes at least one motor having a rotor 114 and stator 116, with a motor cavity 118 defined between the rotor 114 and the stator 116. The pump 100 is operable to direct the fluid medium via the pump head 102 and the motor cavity 118 when pumping the fluid medium from the input port arrangement 110 to the output port arrangement 108, as indicated by arrows.

Figure 2:
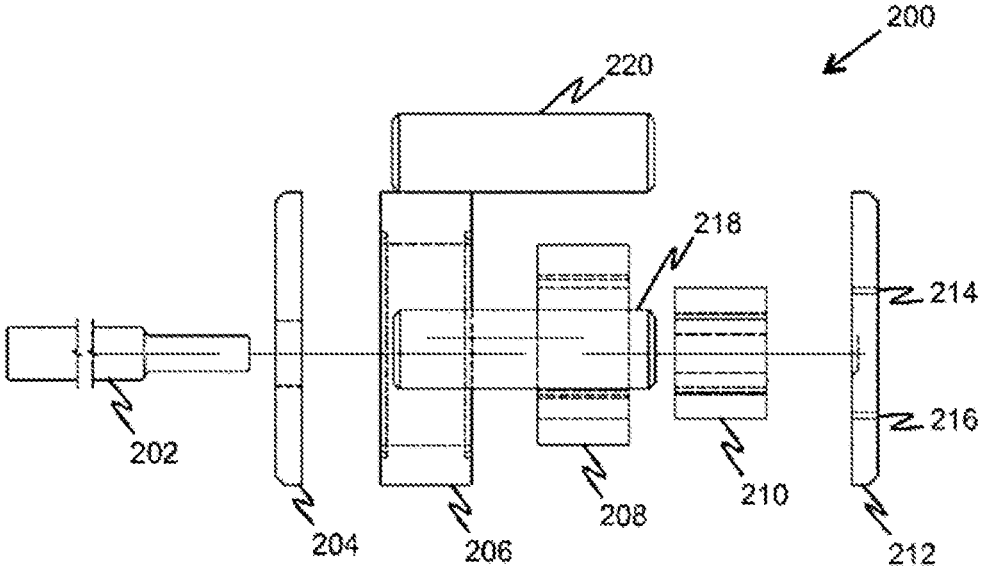
FIG. 2 is an illustration of an exploded view of a gerotor pump, in accordance with an embodiment of the present disclosure.

FIG. 2 is an illustration of an exploded view of a gerotor pump 200. As shown, the gerotor pump 200 includes a pump head (such as the pump head 102 of FIG. 1) comprising a gerotor cylinder 206. The pump head includes a configuration of gerotors 208, 210 for pumping in operation a fluid medium from an input port arrangement 216 to an output port arrangement 214. Furthermore, the gerotor pump 200 includes a motor arrangement, such as the motor arrangement 112 of FIG. 1, for providing mechanical power in operation for actuating the configuration of gerotors 208, 210. The configuration of gerotors includes an outer gerotor 208 and an inner gerotor 210 that are operable to cooperate to entrap and propel the fluid medium from the input port arrangement 216 to the output port arrangement 214. Furthermore, at least one of the outer gerotor 208 and the inner gerotor 210 are fabricated from a flexible material and/or are internally structured so as to exhibit a flexible peripheral exterior surface in operation, and the outer gerotor 208 and the inner gerotor 210 are loaded and/or are assembled together in a preloaded state, within the pump head, so that a gap formed between the gerotors 208, 210 whereat they mutually cooperate for entrapping and propelling the fluid medium is maintained in a flexibly compressed state when the pump 200 is in operation. As shown, the pump 200 further includes a front face 212 and a back face 204 that are coupled to the gerotor cylinder 206. Furthermore, the motor arrangement (such as the motor arrangement 112 of FIG. 1) comprises a drive shaft 202 coupled to the inner gerotor (such as the rotor 114 of FIG. 1). The drive shaft 202 is further coupled to the inner gerotor 210 for providing mechanical power thereto. Moreover, locator pins 218, 220 are used for assembling of the pump 200.

Figure 3:
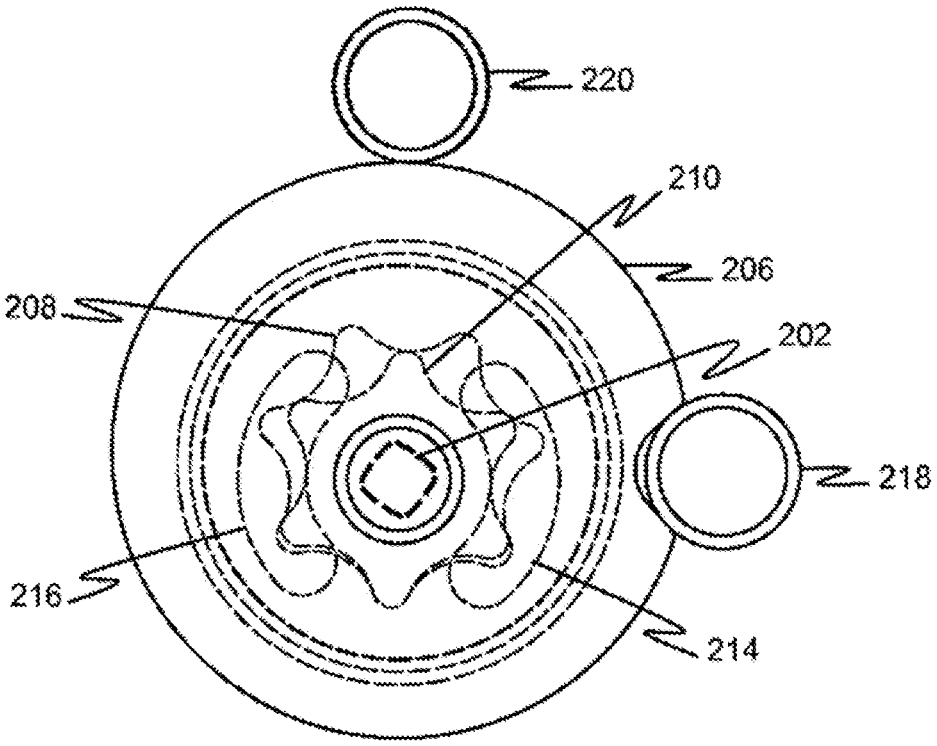
FIG. 3 is an illustration of a front view of the gerotor pump (such as the gerotor pump of FIG. 2), in accordance with an embodiment of the present disclosure.

FIG. 3 is an illustration of a front view of the gerotor pump (such as the gerotor pump 200 of FIG. 2), in accordance with an embodiment of the present disclosure. As shown, the gerotor pump 200 includes a pump head including a configuration of gerotors 208, 210 for pumping in operation a fluid medium from an input port arrangement 216 to an output port arrangement 214. The configuration of gerotors includes an outer gerotor 208 and an inner gerotor 210 that are operable to cooperate to entrap and propel the fluid medium from the input port arrangement 216 to the output port arrangement 214. As shown, the drive shaft 202 is coupled to the inner gerotor 210.

Figure 4:
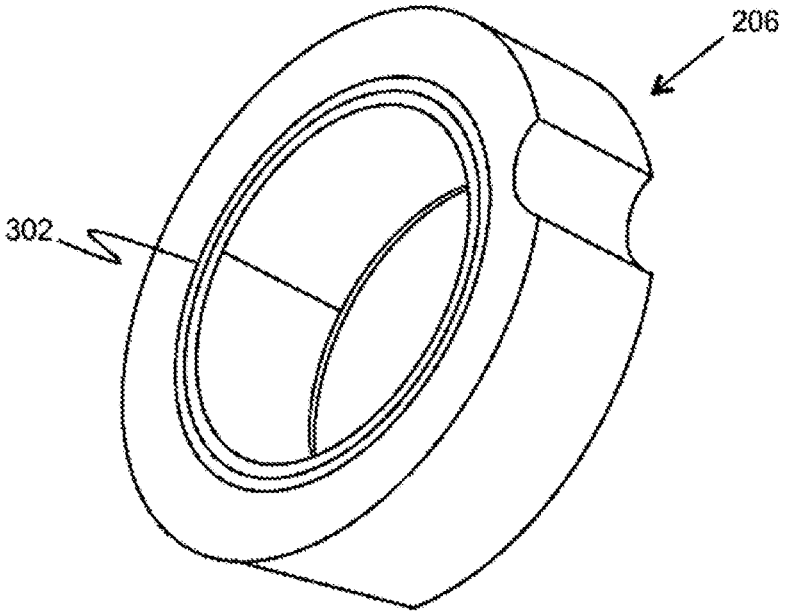
FIG. 4 is an illustration of a perspective view of the gerotor cylinder (such as the gerotor cylinder of FIG. 2), in accordance with an embodiment of the present disclosure.

FIG. 4 is an illustration of a perspective view of the gerotor cylinder 206 (such as the gerotor cylinder of FIG. 2), in accordance with an embodiment of the present disclosure. As shown, the gerotor cylinder 206 comprises a cavity 302 for accommodating the configuration of gerotors (such as the outer gerotor 208 and the inner gerotor 210) therein.

Figure 5:
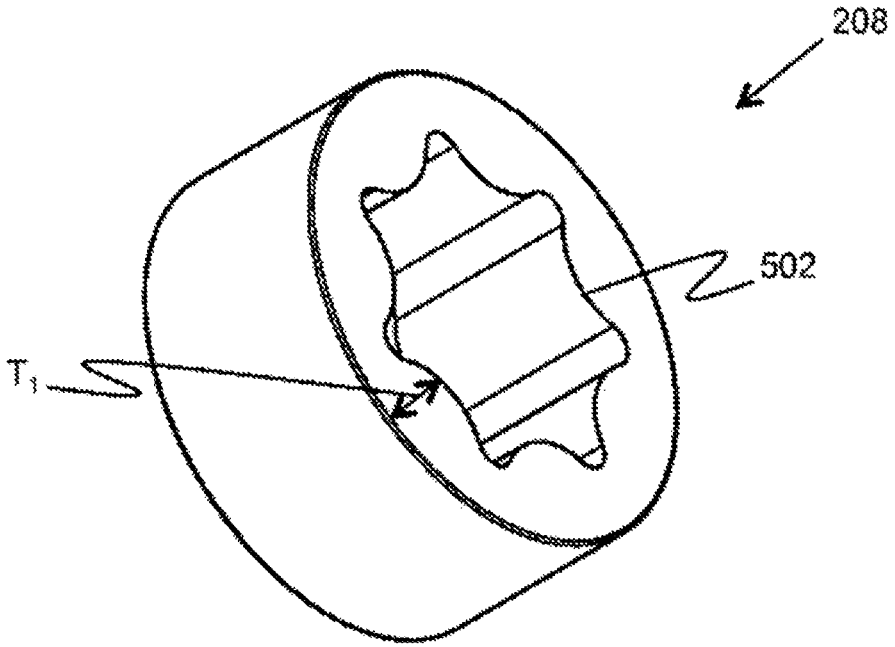
FIG. 5 is an illustration of a perspective view of the outer gerotor (as shown in FIG. 2), in accordance with an embodiment of the present disclosure.
Figure 6:
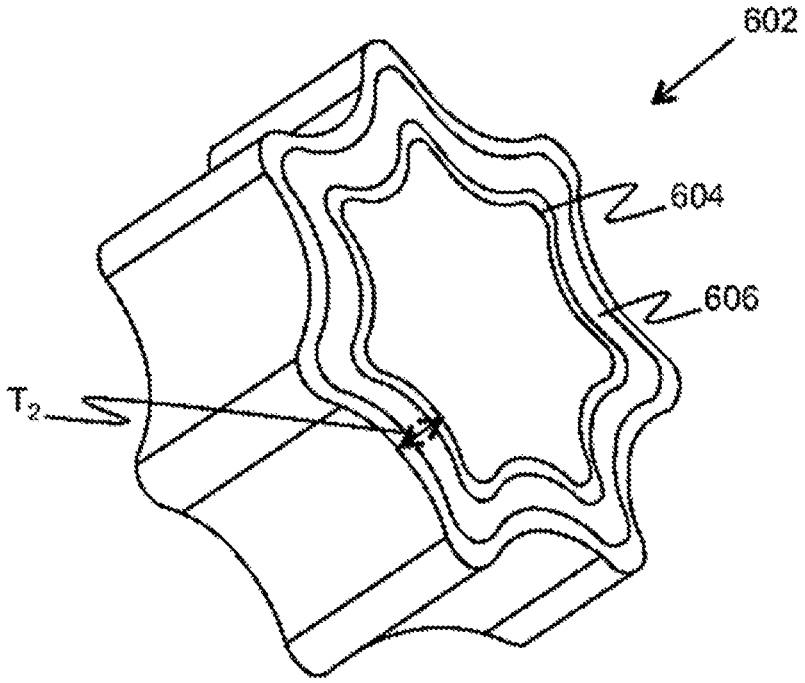
FIG. 6 is an illustration of a perspective view of an exemplary outer gerotor having a thin form, in accordance with an embodiment of the present disclosure.

FIG. 5 is an illustration of a perspective view of the outer gerotor 208 (as shown in FIG. 2), in accordance with an embodiment of the present disclosure. As shown, the outer gerotor 208 includes a cavity 502 for assembly of the inner gerotor therewith. Furthermore, the outer gerotor 208 has a radial wall thickness $T_1$. FIG. 6 is an illustration of a perspective view of an exemplary outer gerotor 602 having a thin form, in accordance with an embodiment of the present disclosure. As shown, the thin outer gerotor 602 has a cavity 604 for assembly of an inner gerotor (such as the inner gerotor 210 of FIG. 2) therewith. Furthermore, the thin outer gerotor 602 has a radial wall thickness $T_2$ that is lower than the radial wall thickness of an outer gerotor having a thick form, such as the outer gerotor 208 of FIG. 5. Moreover, the thin outer gerotor 602 comprises a channel 606 to increase elasticity along the axis thereof.

Figure 7:
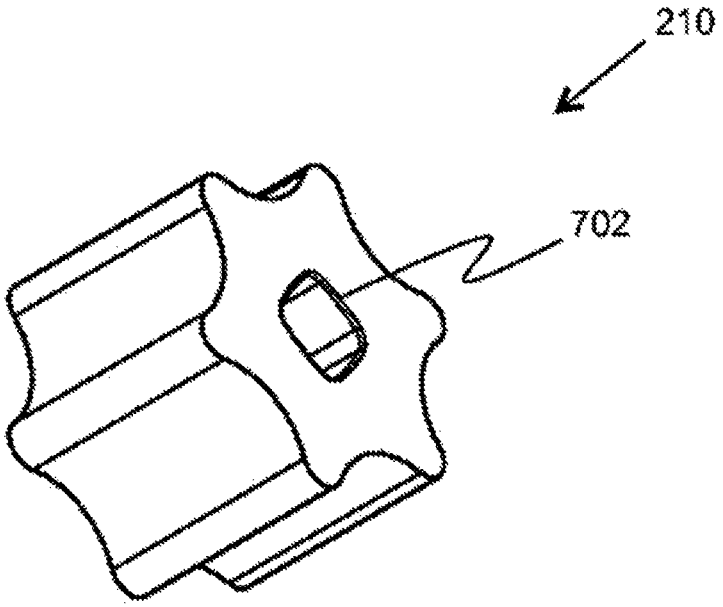
FIG. 7 is an illustration of a perspective view of the inner gerotor (such as the inner gerotor shown in FIG. 2), in accordance with an embodiment of the present disclosure.

FIG. 7 is an illustration of a perspective view of the inner gerotor 210 (such as the inner gerotor shown in FIG. 2), in accordance with an embodiment of the present disclosure. As shown, the inner gerotor 210 includes a cavity 702 for accommodating a drive shaft (such as the drive shaft 202) therein.

Figure 8:
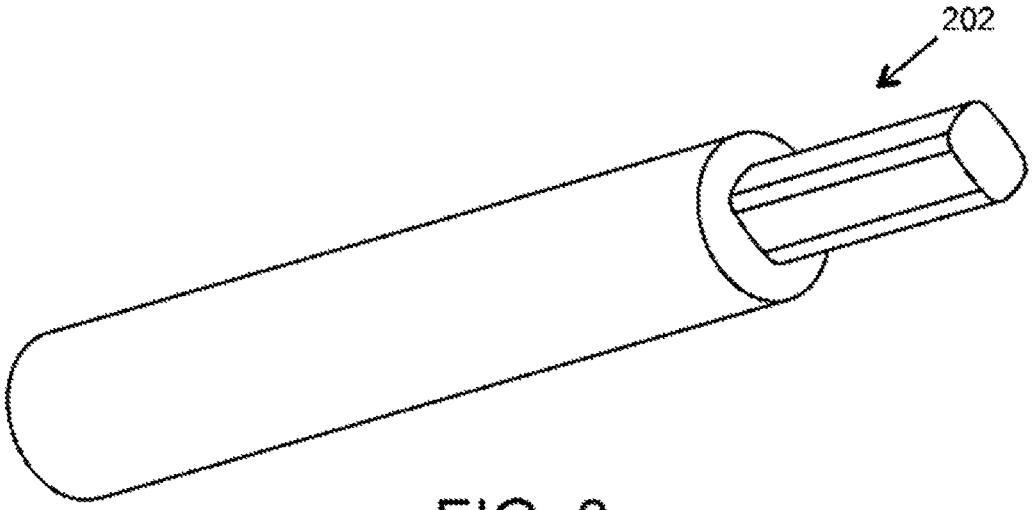
FIG. 8 is an illustration of a perspective view of the drive shaft (such as the drive shaft shown in FIG. 2), in accordance with an embodiment of the present disclosure.

FIG. 8 is an illustration of a perspective view of the drive shaft 202 (such as the drive shaft shown in FIG. 2), in accordance with an embodiment of the present disclosure.

Figure 9:
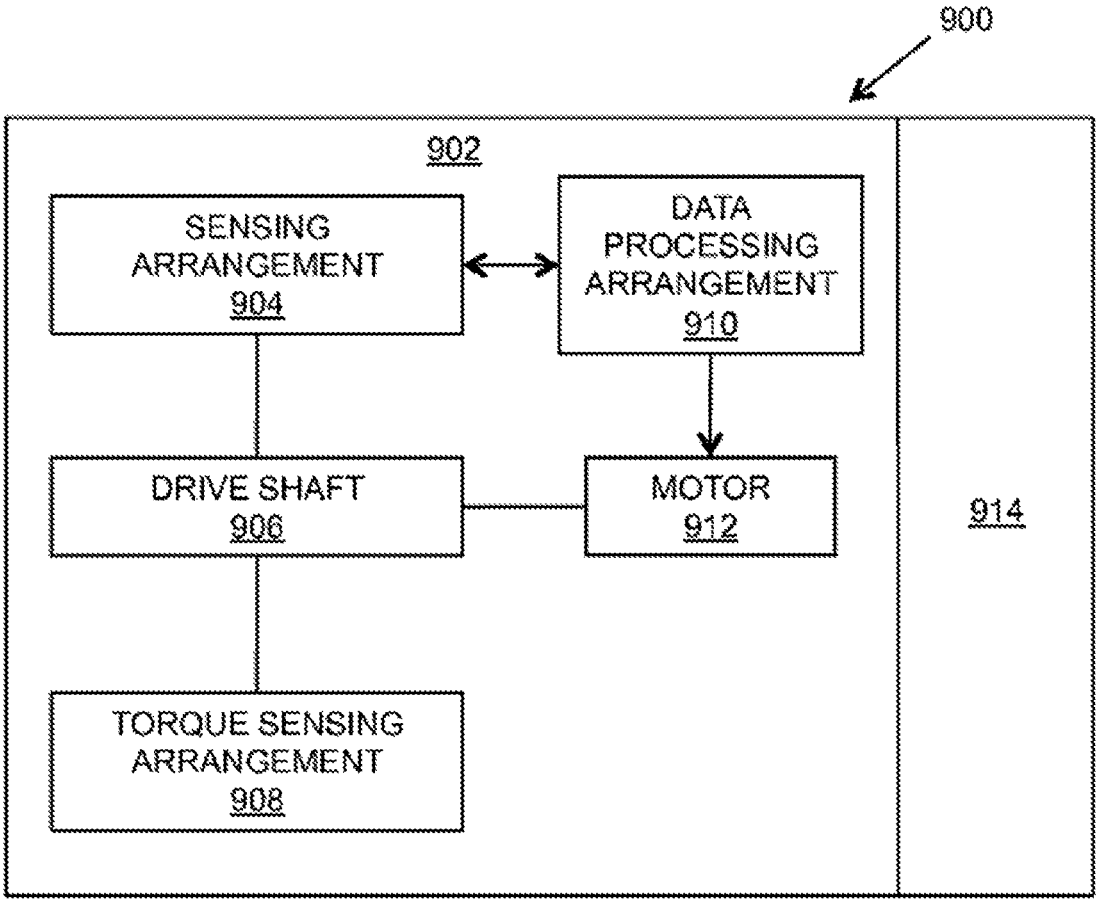
FIG. 9 is a block diagram of an exemplary pump, in accordance with an embodiment of the present disclosure.

FIG. 9 is a block diagram of an exemplary pump 900, in accordance with an embodiment of the present disclosure. The pump 900 includes a pump head 914 utilizing in operation one or more moveable components (such as the outer gerotor 208 and the inner gerotor 210 of FIG. 2) for pumping a fluid medium from an input port arrangement to an output port arrangement (such as the input port arrangement 216 and the output port arrangement 214). The pump 900 further includes a motor arrangement 902 coupled to the pump head 914 for providing mechanical power for moving the one or more moveable components for pumping the fluid medium. As shown, the motor arrangement 902 includes a sensing arrangement 904 for monitoring an angular position of a drive shaft 906 of at least one motor 912 that is used in operation for providing the mechanical power to the pump head 914. Furthermore, the pump 900 includes a data processing arrangement 910 for receiving an angle-indicative signal or a rotation-rate indicative signal from the sensing arrangement 904, and controlling electrical power applied to the at least one motor 912, for controlling pumping of the fluid medium from the input port arrangement to the output port arrangement. Furthermore, the drive shaft 906 is provided with a torque-sensing arrangement 908 for generating a signal indicative of torque applied to the shaft 906 in operation, and the data processing arrangement 910 is operable to apply an angular correction to the angle-indicative signal or the rotation-rate indicative signal to compensate for angular flexure of the drive shaft 906 and the gerotors when the pump 900 is operable to pump the fluid medium from the input port arrangement to the output port arrangement.

Figure 10:
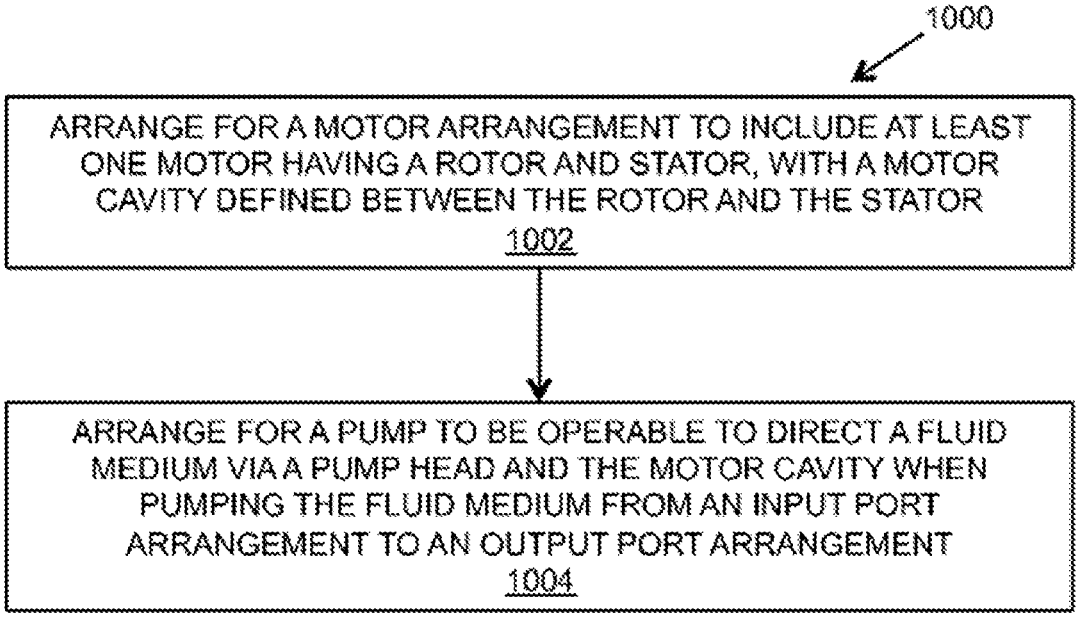
FIG. 10 is an illustration of steps of a method for (namely, a method of) producing a pump (such as the pump of FIG. 1), in accordance with an embodiment of the present disclosure.

FIG. 10 is an illustration of steps of a method of producing a pump (such as the pump 100 of FIG. 1), in accordance with an embodiment of the present disclosure. The pump including a pump head utilizing in operation one or more moveable components for pumping a fluid medium from an input port arrangement to an output port arrangement, and a motor arrangement coupled to the pump head for providing mechanical power for moving the one or more moveable components for pumping the fluid medium. At a step 1002, the motor arrangement is arranged to include at least one motor having a rotor and stator, with a motor cavity defined between the rotor and the stator. At a step 1004, the pump is arranged to be operable to direct the fluid medium via the pump head and the motor cavity when pumping the fluid medium from the input port arrangement to the output port arrangement.

Figure 11:
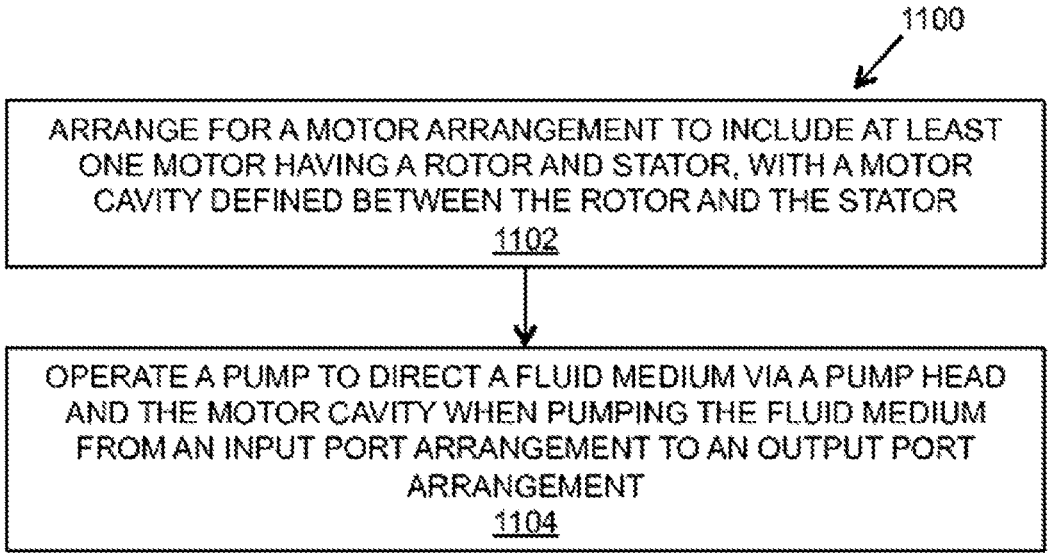
FIG. 11 is an illustration of steps of a method for (namely, a method of) operating a pump (such as the pump of FIG. 1), in accordance with an embodiment of the present disclosure.

FIG. 11 is an illustration of steps of a method 1100 of operating a pump (such as the pump 100 of FIG. 1), in accordance with an embodiment of the present disclosure. The pump includes a pump head utilizing in operation one or more moveable components for pumping a fluid medium from an input port arrangement to an output port arrangement, and a motor arrangement coupled to the pump head for providing mechanical power for moving the one or more moveable components for pumping the fluid medium. At a step 1102, the motor arrangement is arranged to include at least one motor having a rotor and stator, with a motor cavity defined between the rotor and the stator. At a step 1104, the pump is operated to direct the fluid medium via the pump head and the motor cavity when pumping the fluid medium from the input port arrangement to the output port arrangement.

Figure 12:
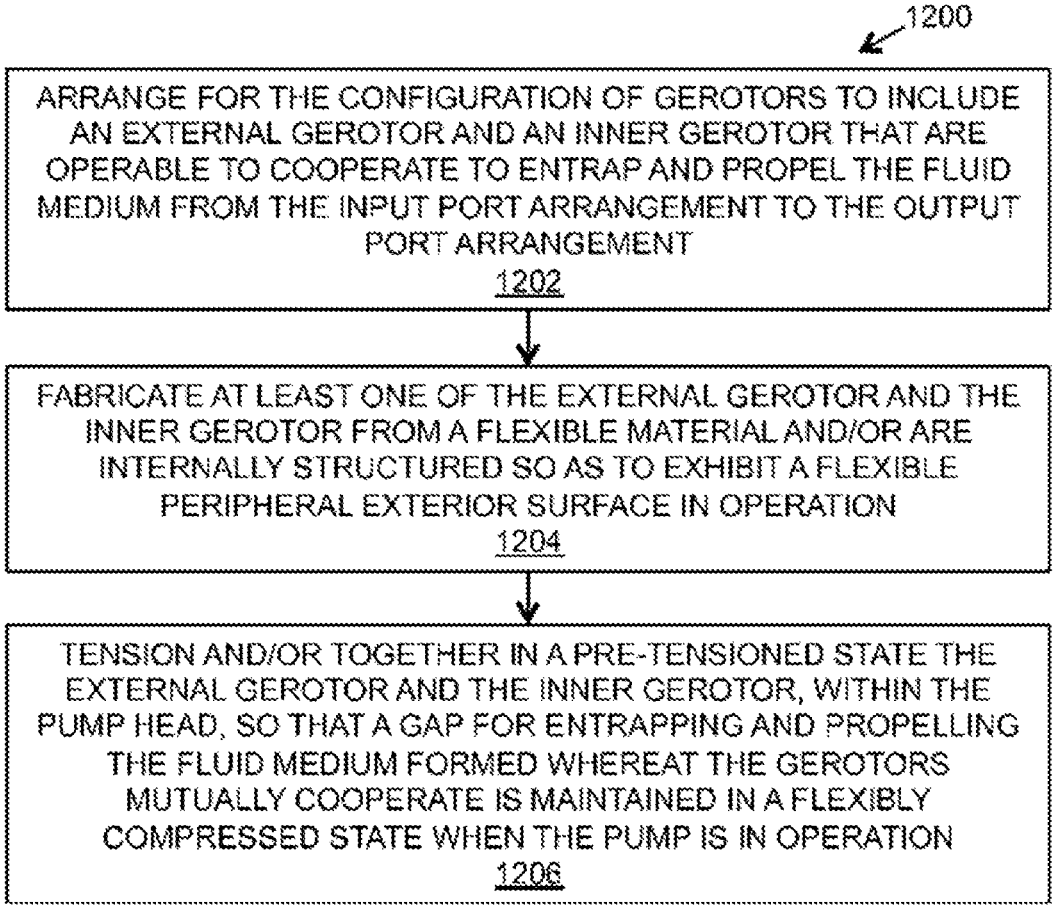
FIG. 12 is an illustration of steps of a method for (namely, a method of) producing a gerotor pump (such as the pump of FIG. 2), in accordance with an embodiment of the present disclosure.

FIG. 12 is an illustration of steps of a method of producing a gerotor pump (such as the pump 200 of FIG. 2), in accordance with an embodiment of the present disclosure. The pump includes a pump head including a configuration of gerotors for pumping in operation a fluid medium from an input port arrangement to an output port arrangement, and a motor arrangement for providing mechanical power in operation for actuating the configuration of gerotors. At a step 1202, the configuration of gerotors is arranged to include an outer gerotor and an inner gerotor that are operable to cooperate to entrap and propel the fluid medium from the input port arrangement to the output port arrangement. At a step 1204, at least one of the outer gerotor and the inner gerotor is fabricated from a flexible material and/or are internally structured so as to exhibit a flexible peripheral exterior surface in operation. At a step 1206, the outer gerotor and the inner gerotor are loaded and/or assembled together in a preloaded state, within the pump head, so that a gap for entrapping and propelling the fluid medium formed whereat the gerotors mutually cooperate is maintained in a flexibly compressed state when the pump is in operation.

The steps 1202 to 1206 are only illustrative and other alternatives can also be provided where one or more steps are added, one or more steps are removed, or one or more steps are provided in a different sequence without departing from the scope of the claims herein. For example, the gerotors may be assembled in a preloaded state by including expansion tool between the gerotors mounted into the pump head, and then removing the expansion tool.

As aforementioned, the inner gerotor and outer gerotor are beneficially manufactured using at least one of: casting, milling, turning, grinding, lapping, superfinishing, physical vapour deposition, 3-D printing techniques, chemical vapour deposition, sintering, laser ablation machining, spark erosion. Such techniques can be used individually or on combination for manufacturing the gerotors. For example, 3-D printing techniques, casting, milling, turning, sintering and grinding are beneficially used for defining a rough form for the gerotors, and then polishing, lapping, superfinishing, physical vapour deposition (of surface layers), chemical vapour deposition and similar are employed thereafter for obtaining a super-precise or super-accurate final form for the gerotors. By "super-precise" or "super-accurate" is meant to gerotor pair matching precision (for engaging surfaces) or absolute machining of better than 10 μm error, more optionally better than 1 μm error. Optionally, laser ablation contouring is also optionally employed to achieve a super-precise or super-accurate manufacture of the gerotors.

Although fabrication of the gerotors from stainless steel or polyether ether ketone is described in the foregoing, it will be appreciated that other materials can alternatively, or additionally be employed for manufacturing the gerotors. As aforementioned, it is beneficial that at least one of a pair of the inner gerotor and the outer gerotor is manufactured from a compliant, namely flexible, material. However, it will be appreciated that all materials exhibit a degree of compliance or flexibility, so what is meant by "flexible" and "inflexible" will be further elucidated below for ensuring clarity in the context of the present disclosure.

With respect to the materials for the inner gerotor and the outer gerotor, it will be appreciated that embodiments of the present disclosure require a complementary pair to be employed for a given pump with at least one, for example only the outer gerotor, of the gerotors being compliant, at least at its exterior surface; optionally, both the outer gerotor and the inner gerotor are compliant. The compliance of the at least one gerotor depends both on a material from which the at least one gerotor is fabricated and a physical spatial form of the at least one gerotor. For example, a thick section of low modulus material such as UHMWPE (Young's Modulus ~900 MPa) or PTFE (Young's Modulus ~500 MPa) and a very thin section of stainless steel (Young's Modulus ~190 GPa for 316L grade stainless steel) potentially have substantially equal compliances from when employed for manufacturing a given gerotor.

Although use of stainless steel and/or polyether ether ketone is described in the foregoing for manufacturing the gerotors, it will be appreciated that alternative materials are optionally employed, for example:

(A) plastics materials, for example filled polymer materials, alternatively for example unfilled polymer materials, such as:
  (i) Flurosint®, which is a mechanically enhanced filled Polytetrafluoroethylene (PTFE), namely a synthetic fluoropolymer of tetrafluoroethylene, for example Flurosint HPV®:
  (ii) UHMWPE (Ultra-high-molecular-weight polyethylene); this plastics material UHMWPE is a subset of the thermoplastic polyethylene; UHMWPE is also known as a high-modulus polyethylene, (HMPE), wherein UHMWPE has extremely long Carbon atom chains, with a molecular mass that is usually in a range of 3.5 and 7.5 million amu (atomic mass units); HPV ("high pressure velocity") grades of UHMWPE are especially suitable for fabricating the gerotors;
  (iii) PET. Namely "Polyethylene terephthalate" (sometimes written as "poly(ethylene terephthalate"), especially HPV grades such as Ertalyte TX® manufactured by Quadrant group of companies (see https://www.quadrantplastics.com/eu-en/products.html), are beneficially employed for manufacturing the gerotors;
  (iv) PAI (Polyamide-imides), which are either thermosetting or thermoplastic, amorphous polymers that have exceptional mechanical, thermal and chemical resistant properties; Polyamide-imides are used extensively as wire coatings in making magnet wire. They are prepared from isocyanates and TMA (trimellic acid-anhydride) in N-methyl-2-pyrrolidone (NMP), especially HPV grades thereof, such as Duratron T4301®, are beneficially employed for manufacturing the gerotors;

(B) elastomers, optionally including a higher modulus backing, wherein FKM®, EDPM®, NBR® and Fluro-silicone® are commercially available elastomer products that are beneficially employed for manufacturing the gerotors;

(C) fiber- (fibre-) reinforced plastic materials, for example:
  (i) carbon fiber (fibre) reinforced epoxy resin, for example Carbon nanofibre reinforced epoxy resin; and
  (ii) Spectra®/Dyneema®-reinforced polyethylene, wherein Dyneema® pertains to stretch-hardened polyethylene that has a strength-to-weight ratio that is circa an order of magnitude higher than stainless steel;

(D) metals, for example elemental metals or metal alloys, for example:
  (i) stainless steel, for example austenitic stainless steel (for example, as often employed for manufacturing inner containment vessels of nuclear reactors);
  (ii) phosphor bronze alloy;
  (iii) spring steel, such as SAE5160 grade spring steel, although such a type of steel is not optimal for use with pumping aqueous fluid media on account of corrosion issues, thus is primarily suitable for non-aqueous fluid media, wherein the spring steel is beneficially employed for manufacturing the gerotors;

(E) ceramic materials (ˆceramics"), namely ceramic-like substances, such as:
  (i) Tungsten Carbide:
  (ii) Carbon Boride; (iii) Silicon Carbide, wherein this material is especially suitable for use in nuclear reactors and nuclear reprocessing facilities because Silicon Carbide can withstand unusually large amounts of high-energy ionizing radiation and neutron flux without exhibiting significant structure degradation or corrosion; use of Silicon Carbide for manufacturing the gerotors is especially suitable for nuclear materials reprocessing facilities, for example at Sellafield (GB), Mayak (Russia) and Hanford (USA); use of Silicon Carbide for the gerotors beneficially enables, for example, a radioactive isotope separator to be realized by combining a Bernoulli separator (see http://www.bernoulli.se/products/centrifugal-separators) with a gerotor pump of the present disclosure, for example beneficially provided with one or more gerotors fabricated using Silicon Carbide, for example for enriching Uranium (i.e. increasing Uranium U235 proportion in a Uranium U235/U238 mixture), for concentrating Plutonium Pu239 and/or Actinide proportions in nuclear reprocessing or manufacturing facilities, for example without a need to use centrifuges that is a conventional known approach; the gerotor pump of the present disclosure is capable of providing an extremely accurately controlled and stable fluid medium flow rate necessary for a Bernoulli-effect isotope separator to function for isotopic separation purposes, that is especially critical when separating out high-molecular weight elemental isotopes such as U235, U239 and Pu239; embodiments of the present disclosure also encompass a gerotor pump employed in combination with Bernoulli-effect separator; a Bernoulli-effect separator operates, for example, by subjecting a flow of a fluid medium along a curved path, to experience centrifugal forces, and then to employ an edge separating arrangement to intercept the flow along the curved path at least partially to separate out various components of the flow that have mutually different density or mass characteristics; optionally, such a Bernoulli-effect separator is also fabricated from Silicon Carbide material; with an estimated 160,000 tonnes of high level nuclear waste Worldwide require reprocessing, embodiments of the present disclosure have great commercial potential in improving the Earth's environment from a radioactive waste legacy of the nuclear era of the $20^{th}$ Century; such embodiments of the present disclosure utilizing radiation-hardened Silicon Carbide materials can also be employed to perform real-time isotopic processing of a molten salt core of a Thorium LFTR power reactor (see http://flibe-energy.com/), for example for extracting Protactinium Pa233 from the molten salt core for providing fissile Uranium U233;

(iv) Zirconia; and (v) Alumina.

It will be appreciated that plastics materials that can be used to fabricate one or more of the gerotors, wherein such plastics materials often have a Young's Modulus in a range of 500 MPa and 7 GPa, and may exhibit both elastic behaviour (behavior) as well as acquiring a permanent set (i.e. dimensional offset) when subject to stress and correspondingly exhibiting strain; some plastics materials can exhibit a degree of permanent set for applied stresses as low as 1 MPa. However, it will also be appreciated that elemental metals (for example Aluminium, Copper, Tungsten) and metal alloys are relatively stiffer, for example having a Young's Modulus in a range of ~70 GPa to 300 GPa, and ceramic materials are yet more relatively stiffer, for example having a Young's Modulus in a range of ~400 GPa to 700 GPa. It will be appreciated that all of these materials, with their associated Young's Modulus ranges, are suitable for use as flexible and inflexible portions of the gerotors. Moreover, it will be appreciated that "flexible" and "inflexible" are relative terms in respect of a given gerotor; for example, the given gerotor is susceptible to being manufactured by using:

(a) a flexible EDPM polymer material (with a Young's Modulus of circa 1 MPa) with an inflexible PTFE polymer material (with a Young's Modulus of circa 190 MPa) for flexible and inflexible regions of the given gerotor, respectively; alternatively (b) a flexible stainless steel (with a Young's Modulus of circa 190 MPa) with an inflexible Tungsten Carbide (WC) ceramic (650 GPa) for flexible and inflexible regions of the given gerotor, respectively.

Figure 13:
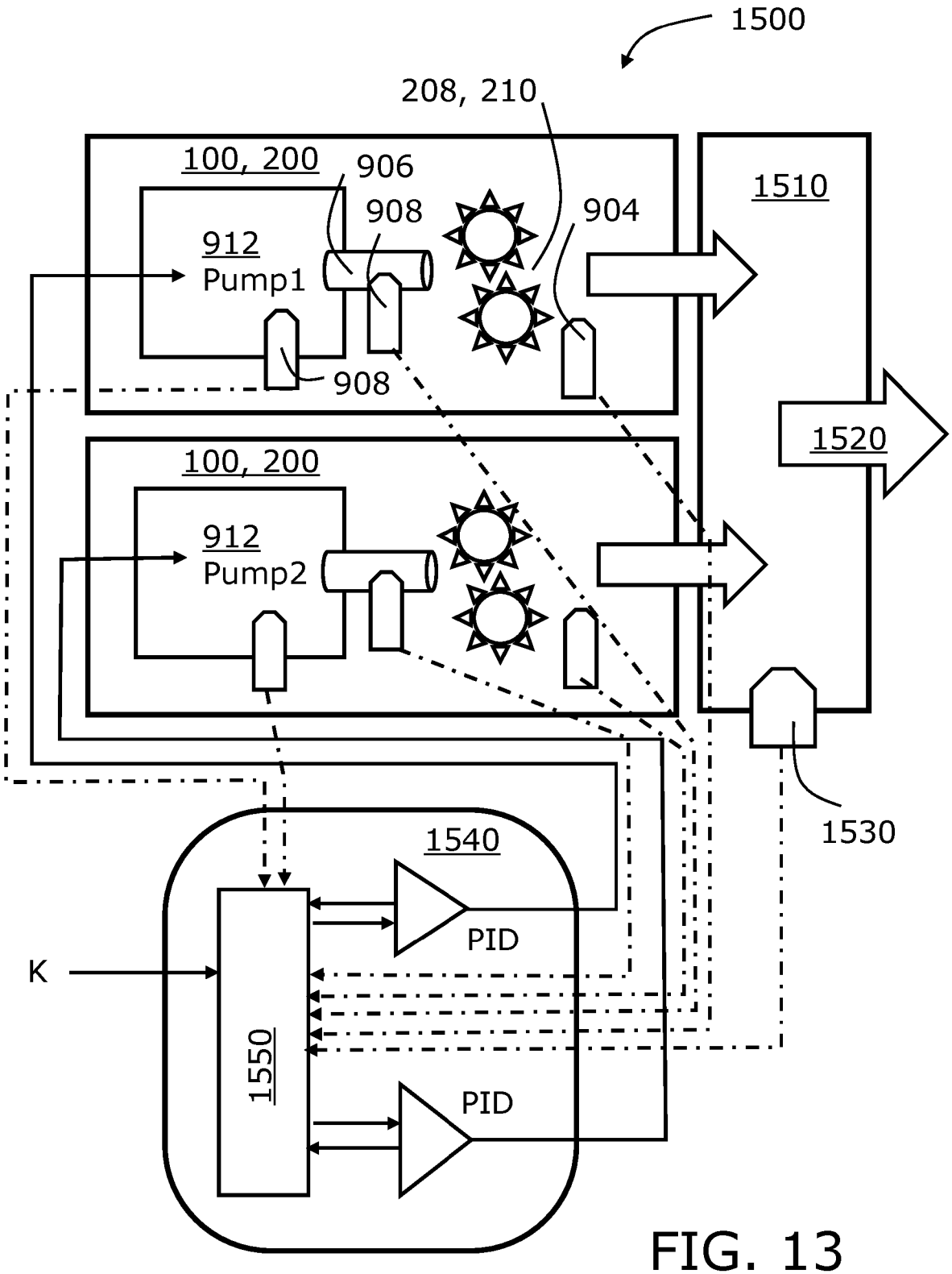
FIG. 13 is an illustration of a plurality of gerotor pumps whose output ports are mutually coupled together to provide a common output port, wherein, in use, rotation rates of the respective rotors of respective motors of the gerotor pumps are mutually synchronized, and wherein an offset angle is applied between the rotors when rotating to reduce pulsation in fluid flow occurring at the common output port.
Figure 13:
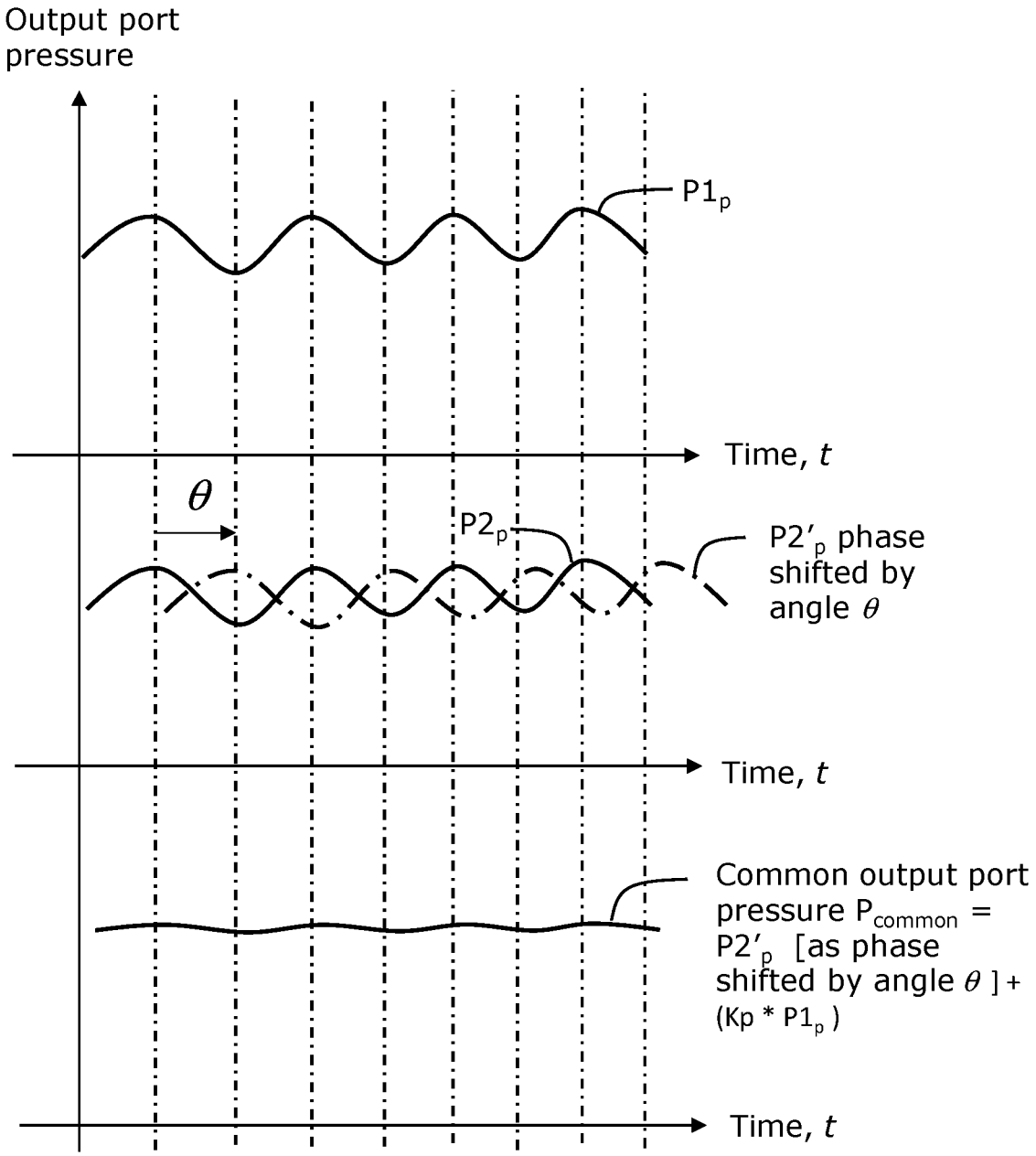

Referring next to FIG. 13, there is shown a pumping apparatus indicated generally by 1500. The umping apparatus 1500 includes a plurality of the pumps 100, 200, for example two such pumps 100, 200 (namely, "Pump1", "Pump2") as shown, for example a pair of such pumps 100, 200. The pumping apparatus 1500 includes a data processing arrangement 1540 that is beneficially configured to control the plurality of gerotor pumps 100, 200 whose output ports are mutually coupled together in close spatial relationship to provide a common output port 1510, wherein each gerotor pump 100, 200 includes a corresponding motor 912 to provide torque to rotate its respective gerotors 208, 210 to pump a fluid through the gerotor pump 100, 200, and the data processing arrangement 1540 is configured to synchronize rotations of rotors 208, 210 of the motors 912 of the plurality of gerotor pumps 100, 200 with at least one adjustable angular offset θ therebetween, wherein the data processing arrangement 1540 is configured to execute an algorithm that adjusts the at least one adjustable angular offset θ to reduce pulsations occurring at the common output port 1510. The at least one adjustable angular offset θ may be considered to be at least one adjustable phase shift between the rotors 906 of the motors 912. The pulsations may be, for example, caused by mutual engagement and disengagement of gerotor teeth, wherein the gerotors 208, 210 are driven by the rotors 906 of the motors 912. By using such an approach, the plurality of gerotor pumps 100, 200 are capable of providing an extremely fast response to changes in required flow rate of fluid at the common output port 1510, whilst providing a reduced degree of pulsations in the flow of fluid at the common output port 1510; such improvement is achieved without needing to use a smoothing reservoir. Optionally, the plurality of gerotor pumps 100, 200 is implemented as two gerotor pumps 100, 200, for example a matched pair of gerotor pumps 100, 200. The aforesaid algorithm is beneficially configured to determine the required at least one angular offset θ by executing a steady-flow-state pulsation calibration routine in which the at least one angular offset θ is determined in an iterative manner to identify one or more values of the at least one angular offset θ at which amplitudes of pulsations are reduced, for example the amplitudes of pulsations are minimized; subsequently, when in normal operation, the one or more values of the at least one angular offset θ are applied to the motors 912. Optionally, the one or more values of the at least one angular offset θ is determined for a range of different fluid flow rates provided at the common output port 1510, wherein the one or more values of at least one angular offsets θ selectively applied to control the plurality of gerotor pumps 100, 200 are varied as a function of the fluid flow rate through the plurality of gerotor pumps 100, 200; in other words, the at least one angular offset θ applied by the algorithm to suppress pulsations at the common output port 1510 is dynamically varied as a function of the fluid flow provided at the common output port 1510. The calibration routine is beneficially used on a periodic basis to recalibrate the plurality of gerotor pumps 100, 200 of the pumping apparatus 1500, for example during maintenance work implemented on the plurality of gerotor pumps 100, 200, to ensure optimal performance of the gerotor pumps 100,200.

In FIG. 13, there is also shown a graph illustrating a manner in which the pump arrangement 1540 provide reduced pulsations of fluid flow 1520 at the common output port 1510. Abscissa axes shown denote time, t. An ordinate axis denotes pressure of fluid flow at the common output port 1510. A first of the pumps 100, 200 generates, when in use, an output pressure component at the common output port 1510 as denotes by $P1_p$. Moreover, a second of the pumps 100, 200 generates, when in use, an output pressure component at the common output port 1510 as denotes by $P2_p$. The data processing arrangement 1540 is configured to apply an offset angle θ to rotation of the motor shaft 906 of the second pump 100, 200 relative to the first pump 100, 200, causing the pulsations generated by the first and second pumps 100, 200 at the common output port 1510 to be in antiphase, to cause an output flow 1520 with reduced pressure fluctuations, as denoted by $P_{common}$ in FIG. 13. Such a reduction in pulsation is achieved at the common output port 1510 without needing to use a smoothing reservoir, therefore preserving a high degree of temporal responsiveness in operation of the pumping apparatus 1500.

In FIG. 13, it will be appreciated that the data processing apparatus 1540 includes a proportional-integral-differential (PID) control for controlling power applied to the motors 912 of the pumps 100, 200. Optionally, differential and integral parameters of the PID control are first order differential and integral parameters; this order ensures predictable operation. Alternatively, when more enhanced operation of the pumping apparatus 1500 is required, differential and integral parameters of the PID control are of higher order then merely first order differential and integral parameters; such higher order copes better with fluid transport delay effects at the output ports of the pumps 100, 200, but is more complex to program to ensure adequate gain and phase margin under all operating conditions of the pumping apparatus 1500. Optionally, the data processing apparatus 1540 includes a mathematical model engine 1550 for providing nested feedback loops to control torque and rotor position control to the pumps 100, 200.

Figure 14:
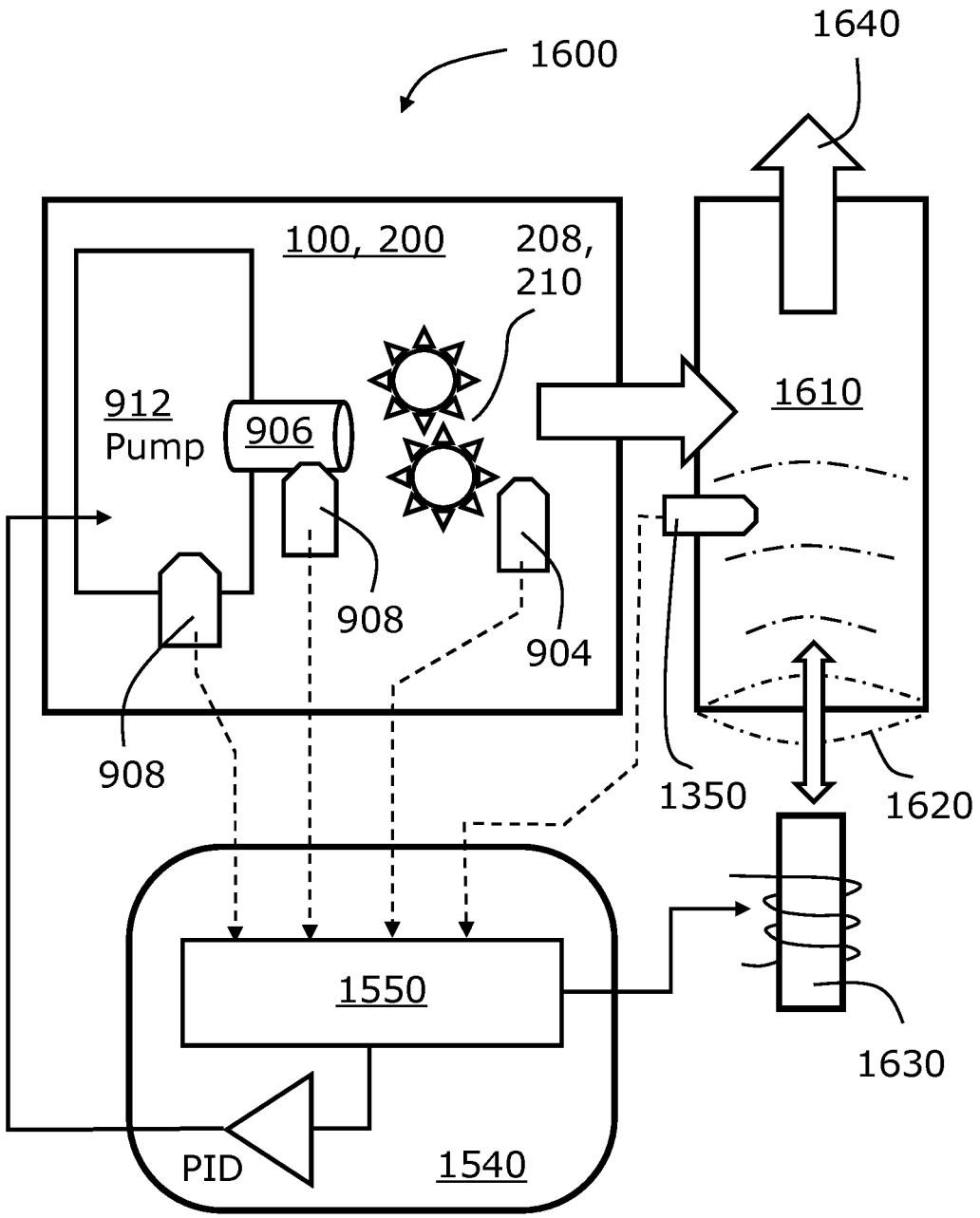
FIG. 14 is an illustration of a gerotor pump provided with a fluid pulsation suppression arrangement at an output port of the gerotor pump, to reduce pulsations at the output port when the gerotor pump is in use, wherein the pulsation suppression arrangement includes an actuator couple to a diaphragm that is configured to project pressure waves into the output port to reduce a magnitude of the pulsations.

Referring next to FIG. 14, as an alternative or addition to using the plurality of gerotor pumps 100, 200 coupled to the common output port 1510 of the pump apparatus 1500 as described in the foregoing with reference to FIG. 13, a pump apparatus indicated generally by 1600 includes a gerotor pump 100, 200 that is provided at its output port 1610 with an actuator 1630 that is configured to move a diaphragm 1620, wherein one side of the diaphragm 1620 that is remote from the actuator 1630 is configured to be in fluid communication with the output port 1610 and fluidically sealed thereto. The actuator 1630 is beneficially implemented as an electro-magnetic actuator or a piezo-electric stack actuator, or a combination of both. The output port 1610 is also provided with a pressure sensor 1350 for sensing pulsations occurring in operation at the output port 1610. There is also provided a data processing arrangement 1540, for example implemented as a microcontroller, for receiving an output signal from the pressure sensor 1350 and processing the output signal, for example using Fast Fourier Transform (FFT) processing, to generate an antiphase signal that is applied to the actuator 1630 to reduce an amplitude of the pulsations at the output port 1610, for example to minimize the pulsations in fluid flow thereat. Optionally, the data processing arrangement 1540 is configured to implement a proportional-integral-differential (PID) control algorithm, wherein corresponding PID coefficients used are optionally dynamically varied as a function of fluid flow 1640 provided at the output port 1610, to ensure optimal suppression of pulsations at the output port 1610. As aforesaid, the pulsations may arise from engagement and disengagement of gerotor teeth of the gerotor pump 100, 200 as its associated gerotors rotate to pump fluid. When more enhanced operation of the pumping apparatus 1600 is required, differential and integral parameters of the PID control are of higher order then merely first order differential and integral parameters; such higher order copes better with fluid transport delay effects at the output port 1610 of the pump 100, 200, but is more complex to program to ensure adequate gain and phase margin under all operating conditions of the pumping apparatus 1600. Optionally, the data processing apparatus 1540 includes a mathematical model engine for providing nested feedback loops to control torque and rotor position control to the pump 100, 200.

Optionally, in the pump apparatus 1500, 1600, the data processing arrangement 1540 is beneficially implemented such that the mathematical model engine 1550 thereof is implemented using artificial intelligence (AI) and/or machine learning (ML) that is implemented by using at least one of a neural network, an adaptive Boltzmann model, a Hidden Markov Model (HMM), a Born machine. Such an adaptive implementation enables the pump apparatus 1500, 1600 to progressively adaptively compensate for wear and tear changes that occur in the pump apparatus 1500, 1600.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

APPENDIX

Statement 1: A gerotor pump including a pump head including a configuration of gerotors for pumping in operation a fluid medium from an input port arrangement to an output port arrangement, and a motor arrangement for providing mechanical power in operation for actuating the configuration of gerotors, wherein the configuration of gerotors includes an inner gerotor and an outer gerotor that are operable to cooperate to entrap and propel the fluid medium from the input port arrangement to the output port arrangement, at least one of the outer gerotor and the inner gerotor are fabricated from a flexible material and/or are internally structured so as to exhibit a flexible peripheral exterior surface in operation, and the outer gerotor and the inner gerotor are loaded and/or are assembled together in a preloaded state, within the pump head, so that a gap formed between the gerotors whereat they mutually cooperate for entrapping and propelling the fluid medium is maintained in a flexibly compressed state when the pump is in operation.

Statement 2. The pump of Statement 1, wherein at least one of the outer and inner gerotors is fabricated from stainless steel or polyether ether ketone.

Statement 3. The pump of Statement 1 or 2, wherein at least one of the outer and inner gerotors is fabricated as a hybrid component including regions of a flexible material therein, and regions of an inflexible material therein.

Statement 4. The pump of Statement 3, wherein the flexible material has a Young's modulus in a range of 0.5 MegaPascal (MPa) to 300 GigaPascals (GPa), and the inflexible material has a Young's modulus in a range of 2 GPa to 1 TPa (Tera Pascal).

Statement 5. The pump of Statement 4, wherein in that the flexible material has a Young's modulus in a range of 1 MegaPascal (MPa) to 5 GigaPascals (GPa), and the inflexible material has a Young's modulus in a range of 2 GPa to 420 GPa.

Statement 6. The pump of any one of the preceding Statements, wherein the pump includes a motor arrangement coupled to provide mechanical power for driving at least one of the inner gerotor and the outer gerotor for pumping the fluid medium, wherein the motor arrangement includes at least one motor having a rotor and stator, with a motor cavity defined between the rotor and the stator, wherein the pump is operable to direct the fluid medium via the motor cavity when pumping the fluid medium from the input port arrangement to the output port arrangement.

Statement 7. The pump of Statement 6, wherein the motor arrangement is arranged to operate such that the fluid medium passing through the motor cavity is operable to cool the motor.

Statement 8. The pump of Statement 6 or 7, wherein the fluid medium is directed in operation through the motor cavity so as to reduce formation of stagnant regions of the fluid medium that are prone to sedimenting or coagulating.

Statement 9. The pump of Statement 8, wherein a spatial variation of flow rate of the fluid medium through regions of the motor cavity is within a range of 10% to 90% of a corresponding aggregated flow rate of the fluid medium through the motor cavity.

Statement 10. The pump of Statement 9, wherein the spatial variation of flow rate of the fluid medium through the regions of the motor cavity is within a range of 30% to 70% of a corresponding aggregated flow rate of the fluid medium through the motor cavity.

Statement 11. The pump of Statement 6, wherein the motor arrangement includes a cooling arrangement for extracting heat generated in the motor arrangement during operation, so that power dissipation occurring in the motor arrangement during operation does not cause heating of the fluid medium when output from the output port arrangement.

Statement 12. The pump of Statement 11, wherein the cooling arrangement includes a Peltier cooling element.

Statement 13. The pump of Statement 6, wherein the motor arrangement includes at least one of: a synchronous motor, a switched reluctance motor, a stepper motor, an induction motor, a DC motor.

Statement 14. The pump of any one of the preceding Statements, wherein at least one of the inner gerotor and the outer gerotor are fabricated, at least in part, from a flexible material, and/or are shaped internally so as to exhibit peripheral flexibility, and are held under tension together during operation to close a gap therebetween that is operable to transport, by viscous drag and entrapment, the fluid medium from the input port arrangement to the output port arrangement.

Statement 15. The pump of any one of the preceding Statements, wherein the inner gerotor and outer gerotor are manufactured using at least one of: casting, milling, turning, grinding, lapping, superfinishing, physical vapour deposition, 3-D printing techniques, chemical vapour deposition, sintering, laser ablation machining, spark erosion.

Statement 16. The pump of Statement 6, wherein:

(i) the motor arrangement includes a sensing arrangement to monitor an angular position of a drive shaft of at least one motor that is used in operation for providing the mechanical power to the pump head; and (ii) the pump includes a data processing arrangement to receive an angle-indicative signal or a rotation-rate indicative signal from the sensing arrangement, and to control electrical power applied to the at least one motor, for controlling pumping of the fluid medium from the input port arrangement to the output port arrangement.

Statement 17. The pump of Statement 16, wherein the motor arrangement is provided with a torque-sensing arrangement for generating a signal indicative of torque applied to the shaft in operation, and the data processing arrangement is operable to apply an angular correction to the angle-indicative signal or the rotation-rate indicative signal to compensate for angular flexure of the drive shaft and the gerotors when the pump is operable to pump the fluid medium from the input port arrangement to the output port arrangement.

Statement 18. An apparatus including the pump of any one of the preceding Statements to provide a flow of a fluid medium, wherein the apparatus further includes a Bernoulli-effect separator for receiving the flow from the pump to separate components of the flow into a plurality of flow paths depending upon densities or masses of the components.

Statement 19. A method for producing a gerotor pump including a pump head including a configuration of gerotors for pumping in operation a fluid medium from an input port arrangement to an output port arrangement, and a motor arrangement for providing mechanical power in operation for actuating the configuration of gerotors, wherein the method includes:

(i) arranging for the configuration of gerotors to include an outer gerotor and an inner gerotor that are operable to cooperate to entrap and propel the fluid medium from the input port arrangement to the output port arrangement;

(ii) fabricating at least one of the outer gerotor and the inner gerotor from a flexible material and/or are internally structured so as to exhibit a flexible peripheral exterior surface in operation; and (iii) loading and/or assembling together in a preloaded state the outer gerotor and the inner gerotor, within the pump head, so that a gap for entrapping and propelling the fluid medium formed whereat the gerotors mutually cooperate is maintained in a flexibly compressed state when the pump is in operation.

Statement 20. The method of Statement 19, wherein the method includes assembling the gerotors in a preloaded state by including an expansion tool between the gerotors mounted into the pump head, and then removing the expansion tool.

Statement 21. The method of Statement 19, wherein the method includes assembling the gerotors in a preloaded state by including linear guiding between the gerotors mounted into the pump head, and then removing the linear guiding.

Statement 22. The method of any one of Statements 19 to 21, wherein the method includes manufacturing the inner gerotor and outer gerotor by using at least one of: casting, milling, turning, grinding, lapping, superfinishing, physical vapour deposition, 3-D printing techniques, chemical vapour deposition, sintering, laser ablation machining, spark erosion.

Statement 23. The method of any one of Statements 19 to 22, wherein the method includes coupling a motor arrangement to provide mechanical power for driving at least one of the inner gerotor and the outer gerotor for pumping the fluid medium, wherein the motor arrangement includes at least one motor having a rotor and stator, with a motor cavity defined between the rotor and the stator, wherein the pump is operable to direct the fluid medium via the motor cavity when pumping the fluid medium from the input port arrangement to the output port arrangement.

Statement 24. The method of Statement 23, wherein the method includes arranging the motor arrangement to operate such that the fluid medium passes through the motor cavity in operation to cool the motor.

Statement 25. The method of Statement 23, wherein the method includes arranging for the fluid medium to be directed in operation through the motor cavity to reduce formation of stagnant regions of the fluid medium that are prone to sedimenting or coagulating.

Statement 26. The method of Statement 25, wherein the method includes arranging for the spatial variation of flow rate of the fluid medium through regions of the motor cavity is within a range of 10% to 90% of a corresponding aggregated flow rate of the fluid medium through the motor cavity.

Statement 27. The method of Statement 26, wherein the method includes arranging for the spatial variation of flow rate of the fluid medium through the regions of the motor cavity is within a range of 30% to 70% of a corresponding aggregated flow rate of the fluid medium through the motor cavity.

Statement 28. The method of Statement 23, wherein the method includes arranging for the motor arrangement to include a cooling arrangement for extracting heat generated in the motor arrangement during operation, so that power dissipation occurring in the motor arrangement during operation does not cause heating of the fluid medium when output from the output port arrangement.

Statement 29. The method of Statement 28, wherein the method includes arranging for the cooling arrangement to include a Peltier cooling element.

Statement 30. The method of Statement 23, wherein the method includes arranging for the motor arrangement to include at least one of: a synchronous motor, a switched reluctance motor, a stepper motor, an induction motor, a DC motor.

Statement 31. The method of any one of Statements 23 to 30, wherein the method includes fabricating at least one of the inner gerotor and the outer gerotor, at least in part, from a flexible material, and/or shaping them internally so as to exhibit peripheral flexibility, and are held under tension together during operation to close a gap therebetween that is operable to transport, by viscous drag and entrapment, the fluid medium from the input port arrangement to the output port arrangement.

Statement 32. The method of any one of Statements 23 to 31, wherein the method includes:

(i) including a sensing arrangement in the motor arrangement to monitor an angular position of a drive shaft of at least one motor that is used in operation for providing the mechanical power to the pump head; and (ii) including a data processing arrangement in the pump that receives an angle-indicative signal or a rotation-rate indicative signal from the sensing arrangement, and that controls electrical power applied to the at least one motor, for controlling pumping of the fluid medium from the input port arrangement to the output port arrangement.

Statement 33. The method of Statement 32, wherein the method includes:

(i) providing the motor arrangement with a torque-sensing arrangement for generating a signal indicative of torque applied to the shaft in operation; and (ii) arranging for the data processing arrangement to apply an angular correction to the angle-indicative signal or the rotation-rate indicative signal to compensate for angular flexure of the drive shaft and the gerotors, when the pump is operable to pump the fluid medium from the input port arrangement to the output port arrangement.

The invention claimed is:

1. A gerotor pump apparatus including at least one gerotor pump including a pump head including a configuration of gerotors for pumping, when in operation, a fluid medium from an input port arrangement to an output port arrangement, and a motor arrangement for providing mechanical power in operation for actuating the configuration of gerotors, wherein the configuration of gerotors includes an inner gerotor and an outer gerotor that are operable to cooperate to entrap and propel the fluid medium from the input port arrangement to the output port arrangement, the outer gerotor and the inner gerotor are loaded and/or are assembled together in a preloaded state, within the pump head, so that a gap formed between the gerotors whereat they mutually cooperate for entrapping and propelling the fluid medium is maintained in a flexibly compressed state when the gerotor pump is in operation, and the gerotor pump apparatus further includes a pulse attenuating arrangement for reducing an amplitude of periodic pulses present at the output port arrangement generated in response to rotation of the outer gerotor and inner gerotor when in use, wherein the pulse attenuation arrangement is configured to apply an at least partially antiphase correction to attenuate the amplitude of the periodic pulses at the output port arrangement, wherein the pulse attenuating arrangement is implemented by configuring a control system to accelerate and/or decelerate one or more gerotors of the at least one gerotor pump with sub-revolution accuracy in partial antiphase with the periodic pulses that are otherwise be generated, to partially attenuate those pulses at the output port arrangement.

2. The gerotor pump apparatus of claim 1, wherein at least one of the outer gerotor and the inner gerotor are fabricated from a flexible material and/or are internally structured so as to exhibit a flexible peripheral exterior surface in operation.

3. The gerotor pump apparatus of claim 1, wherein the pulse attenuating arrangement is implemented by including at least two gerotor pumps or pump heads in the gerotor pump apparatus, wherein the at least two gerotor pumps or pump heads are configured to function with a fixed angular offset between their respective gerotors, and wherein the fixed angular offset between the at least two gerotor pumps or pump heads is configured for the at least two gerotor pumps or pump heads to combine their individual periodic pulses at least partially in antiphase to attenuate the amplitude of the periodic pulses at the output port arrangement.

4. The gerotor pump apparatus of claim 1, wherein the pulse attenuating arrangement is implemented by including at least two gerotor pumps in the gerotor pump apparatus, wherein the at least two gerotor pumps are configured to function with an angular offset between their respective gerotors, and wherein the gerotor pump apparatus includes a data processing arrangement that is configured to sense the periodic pulses at the output port arrangement to generate a sensor signal and to process the sensor signal to generate a required value of the angular offset to be applied to the at least two gerotor pumps to apply the at least partially antiphase correction to attenuate the amplitude of the periodic pulses at the output port arrangement.

5. The gerotor pump apparatus of claim 1, wherein the pulse attenuating arrangement is implemented by including an actuator coupled to vibrate a diaphragm in fluid communication with fluid present in use at the output port arrangement, wherein the gerotor pump apparatus further includes a data processing arrangement that is configured to sense the periodic pulses at the output port arrangement to generate a sensor signal and to process the sensor signal to generate a drive signal to excite the actuator to apply the at least partially antiphase correction to attenuate the amplitude of the periodic pulses at the output port arrangement.

6. The gerotor pump apparatus of claim 1, wherein the periodic accelerations and/or decelerations are determined by using design calculations and/or simulations.

7. The gerotor pump apparatus of claim 1, wherein the periodic accelerations and/or deceleration are determined by using fixed or periodic measurements, calibrations, and tuning.

8. The gerotor pump apparatus of claim 1, wherein the periodic accelerations and/or decelerations are determined by dynamic measurement of operating conditions of the gerotor pump apparatus, such as by performing a pressure and/or a fluid flow measurement.

9. The gerotor pump apparatus of claim 1, wherein the periodic accelerations are determined by a combination of configurations of one or more of the pulse attenuating arrangement is implemented by configuring a control system to accelerate and/or decelerate one or more gerotors of the at least one gerotor pump with sub-revolution accuracy in partial antiphase with the periodic pulses that are otherwise be generated, to partially attenuate those pulses at the output port arrangement; by using design calculations and/or simulations; by using fixed or periodic measurements, calibrations, and tuning; or by dynamic measurement of operating conditions of the gerotor pump apparatus, such as by performing a pressure and/or a fluid flow measurement.

10. The gerotor pump apparatus of claim 1, wherein a data processing apparatus includes a mathematical model engine to provide nested feedback loops to control torque and rotor position control to the pumps.

11. The gerotor pump apparatus of claim 10, wherein the mathematical model engine is implemented using artificial intelligence (AI) and/or machine learning (ML) that is implemented by using at least one of a neural network, an adaptive Boltzmann model, a Hidden Markov Model (HMM), and a Born machine.

12. The gerotor pump apparatus of claim 1, wherein the pulsations or other dynamic flow errors are partially compensated for or cancelled by a combination of configurations.

13. The gerotor pump apparatus of claim 1, wherein at least one of the outer and inner gerotors is fabricated from stainless steel or polyether ether ketone.

14. The gerotor pump apparatus of claim 1, wherein at least one of the outer and inner gerotors is fabricated as a hybrid component including regions of a flexible material therein, and regions of an inflexible material therein.

15. The gerotor pump apparatus of claim 14, wherein the flexible material has a Young's modulus in a range of 0.5 MegaPascal (MPa) to 300 GigaPascals (GPa), and the inflexible material has a Young's modulus in a range of 2 GPa to 1 TPa (Tera Pascal).

16. The gerotor pump apparatus of claim 1, wherein the pump includes a motor arrangement coupled to provide mechanical power for driving at least one of the inner gerotor and the outer gerotor for pumping the fluid medium, wherein the motor arrangement includes at least one motor having a rotor and stator, with a motor cavity defined between the rotor and the stator, wherein the pump is operable to direct the fluid medium via the motor cavity when pumping the fluid medium from the input port arrangement to the output port arrangement.

17. The gerotor pump apparatus of claim 16, wherein the motor arrangement is arranged to operate such that the fluid medium passing through the motor cavity is operable to cool the motor.

18. The gerotor pump apparatus of claim 16, wherein the fluid medium is directed in operation through the motor cavity so as to reduce formation of stagnant regions of the fluid medium that are prone to sedimenting or coagulating.

19. The gerotor pump apparatus of claim 18, wherein a spatial variation of flow rate of the fluid medium through regions of the motor cavity is within a range of 10% to 90% of a corresponding aggregated flow rate of the fluid medium through the motor cavity.

20. The gerotor pump apparatus of claim 16, wherein the motor arrangement includes a cooling arrangement for extracting heat generated in the motor arrangement during operation, so that power dissipation occurring in the motor arrangement during operation does not cause heating of the fluid medium when output from the output port arrangement, optionally wherein the cooling arrangement includes a Peltier cooling element.

21. The gerotor pump apparatus of claim 16, wherein the motor arrangement includes at least one of: a synchronous motor, a switched reluctance motor, a stepper motor, an induction motor, a DC motor.

22. The pump apparatus of claim 16, wherein:

(i) the motor arrangement includes a sensing arrangement to monitor an angular position of a drive shaft of at least one motor that is used in operation for providing the mechanical power to the pump head; and (ii) the pump includes a data processing arrangement to receive an angle-indicative signal or a rotation-rate indicative signal from the sensing arrangement, and to control electrical power applied to the at least one motor, for controlling pumping of the fluid medium from the input port arrangement to the output port arrangement.

23. The pump apparatus of claim 22, wherein the motor arrangement is provided with a torque-sensing arrangement for generating a signal indicative of torque applied to the shaft in operation, and the data processing arrangement is operable to apply an angular correction to the angle-indicative signal or the rotation-rate indicative signal to compensate for angular flexure of the drive shaft and the gerotors when the pump is operable to pump the fluid medium from the input port arrangement to the output port arrangement.

24. The gerotor pump apparatus of claim 1, wherein at least one of the inner gerotor and the outer gerotor are fabricated, at least in part, from a flexible material, and/or are shaped internally so as to exhibit peripheral flexibility, and are held under tension together during operation to close a gap therebetween that is operable to transport, by viscous drag and entrapment, the fluid medium from the input port arrangement to the output port arrangement.

25. The pump apparatus of claim 1, wherein the inner gerotor and outer gerotor are manufactured using at least one of: casting, milling, turning, grinding, lapping, superfinishing, physical vapour deposition, 3-D printing techniques, chemical vapour deposition, sintering, laser ablation machining, spark erosion.

26. A method for producing a gerotor pump apparatus according to claim 1, wherein the gerotor pump apparatus includes at least one gerotor pump including a pump head including a configuration of gerotors for pumping in operation a fluid medium from an input port arrangement to an output port arrangement, and a motor arrangement for providing mechanical power in operation for actuating the configuration of gerotors, wherein the method includes:

(i) arranging for the configuration of gerotors to include an outer gerotor and an inner gerotor that are operable to cooperate to entrap and propel the fluid medium from the input port arrangement to the output port arrangement;

(ii) fabricating at least one of the outer gerotor and the inner gerotor from a flexible material and/or are internally structured so as to exhibit a flexible peripheral exterior surface in operation; and (iii) loading and/or assembling together in a preloaded state the outer gerotor and the inner gerotor, within the pump head, so that a gap for entrapping and propelling the fluid medium formed whereat the gerotors mutually cooperate is maintained in a flexibly compressed state when the pump is in operation.

27. The method of claim 26, wherein the method includes assembling the gerotors in a preloaded state by including an expansion tool between the gerotors mounted into the pump head, and then removing the expansion tool.

28. The method of claim 26, wherein the method includes assembling the gerotors in a preloaded state by including linear guiding between the gerotors mounted into the pump head, and then removing the linear guiding.

29. The method of claim 26, wherein the method includes manufacturing the inner gerotor and outer gerotor by using at least one of: casting, milling, turning, grinding, lapping, superfinishing, physical vapour deposition, 3-D printing techniques, chemical vapour deposition, sintering, laser ablation machining, spark erosion.

* * * * *